US011002156B2

(12) United States Patent
Hughes et al.

(10) Patent No.: US 11,002,156 B2
(45) Date of Patent: May 11, 2021

(54) NON-CONTACTING ACTUATOR FOR ROCKER ARM ASSEMBLY LATCHES

(71) Applicant: Eaton Corporation, Cleveland, OH (US)

(72) Inventors: Douglas Anthony Hughes, Novi, MI (US); Matthew Richard Busdiecker, Beverly Hills, MI (US); Dale Arden Stretch, Novi, MI (US); Mark Allan Juds, New Berlin, WI (US)

(73) Assignee: Eaton Intelligent Power Limited, Dublin (IE)

( * ) Notice: Subject to any disclaimer, the term of this patent is extended or adjusted under 35 U.S.C. 154(b) by 96 days.

(21) Appl. No.: 15/432,026

(22) Filed: Feb. 14, 2017

(65) Prior Publication Data

US 2017/0183982 A1 Jun. 29, 2017

Related U.S. Application Data

(63) Continuation-in-part of application No. PCT/US2015/045774, filed on Aug. 18, 2015.
(Continued)

(51) Int. Cl.
*F01L 1/18* (2006.01)
*F01L 1/24* (2006.01)
(Continued)

(52) U.S. Cl.
CPC ..... *F01L 1/185* (2013.01); *F01L 1/24* (2013.01); *F01L 1/267* (2013.01);
(Continued)

(58) Field of Classification Search
CPC ..... F01L 1/185; F01L 13/0005; F01L 1/267; F01L 1/24; F01L 2820/03; F01L 2105/00;
(Continued)

(56) References Cited

U.S. PATENT DOCUMENTS 4,203,397 A 5/1980 Soeters, Jr.
5,544,626 A 8/1996 Diggs et al.
(Continued)

FOREIGN PATENT DOCUMENTS

DE 10310220 A1 9/2004
EP 2050933 A1 4/2009
WO WO 2016197088 A1 * 12/2016 ..... F01L 1/185

*Primary Examiner* — Mark A Laurenzi
*Assistant Examiner* — Wesley G Harris
(74) *Attorney, Agent, or Firm* — Paul V. Keller

(57) ABSTRACT

An internal combustion engine includes a valvetrain having a rocker arm assembly including a rocker arm on which a latch pin is mounted. An actuator for the latch pin, including an electromagnet, is mounted separately from the rocker arm. Therefore, the rocker arm is able to move independently from the electromagnet. The electromagnet is operative to cause the latch pin to actuate through magnetic flux following a magnetic circuit that passes through the rocker arm. Mounting the electromagnet apart from the rocker arm allows wires powering the electromagnet to be held in relatively static positions. The magnetic circuit is arranged to bring magnetic flux into the latch pin, or a co-acting part, within the volume of the rocker arm. This enables a compact design that is suitable for installation in engines where the available space under the valve cover may be very limited.

32 Claims, 22 Drawing Sheets

Related U.S. Application Data

(60) Provisional application No. 62/409,263, filed on Oct. 17, 2016.

(51) Int. Cl.
*F01L 1/26* (2006.01)
*F01L 13/00* (2006.01)

(52) U.S. Cl.
CPC ..... *F01L 13/0005* (2013.01); *F01L 2001/186* (2013.01); *F01L 2001/187* (2013.01); *F01L 2101/00* (2013.01); *F01L 2105/00* (2013.01); *F01L 2820/03* (2013.01)

(58) Field of Classification Search
CPC ..... F01L 2101/00; F01L 2001/186; F01L 2001/187; F01L 2820/031
See application file for complete search history.

(56) References Cited

U.S. PATENT DOCUMENTS

| | | | | |
|---|---|---|---|---|
| 5,619,958 | A * | 4/1997 | Hampton | F01L 1/185 123/198 F |
| 6,318,318 | B1 | 11/2001 | Jahr | |
| 2003/0200947 | A1* | 10/2003 | Harris | F01L 1/053 123/90.43 |
| 2008/0006232 | A1 | 1/2008 | Gregor et al. | |
| 2017/0241300 | A1* | 8/2017 | Liskar | F01L 13/0005 |
| 2018/0142583 | A1* | 5/2018 | Liskar | F01L 1/185 |
| 2018/0195419 | A1* | 7/2018 | Liskar | F01L 1/185 |

* cited by examiner

NON-CONTACTING ACTUATOR FOR ROCKER ARM ASSEMBLY LATCHES

FIELD

The present teachings relate to valvetrains, particularly valvetrains providing variable valve lift (VVL) or cylinder deactivation (CDA).

BACKGROUND

Hydraulically actuated latches are used on some rocker arm assemblies to implement variable valve lift (VVL) or cylinder deactivation (CDA). For example, some switching roller finger followers (SRFF) use hydraulically actuated latches. In these systems, pressurized oil from an oil pump may be used for latch actuation. The flow of pressurized oil may be regulated by an oil control valve (OCV) under the supervision of an Engine Control Unit (ECU). A separate feed from the same source provides oil for hydraulic lash adjustment. This means that each rocker arm has two hydraulic feeds, which entails a degree of complexity and equipment cost. The oil demands of these hydraulic feeds may approach the limits of existing supply systems. In addition, there is a need to provide on board diagnostic information for cylinder deactivating and switching rocker arm assemblies.

SUMMARY

The present teachings relate to a valvetrain suitable for an internal combustion engine that includes a combustion chamber, a moveable valve having a seat formed within the combustion chamber, and a camshaft. The valvetrain includes a rocker arm assembly that has a rocker arm and a cam follower configured to engage a cam on the camshaft as the camshaft rotates. In the present teachings, the valvetrain further includes a latch assembly. The latch assembly includes a latch pin mounted on the rocker arm and an actuator. The actuator includes an electromagnet. The actuator parts are mounted on components distinct from the rocker arm, whereby the rocker arm with the latch pin mounted to it has a freedom of movement independent from the electromagnet. The actuator is operative on the latch pin through magnetic force and does not require a mechanical interface with the latch pin.

The latch pin is moveable between first and second positions. The electromagnet is operable to cause the latch pin to translate between the first and second positions. One of the first and second latch pin positions may provide a configuration in which the rocker arm assembly is operative to actuate the moveable valve in response to rotation of the camshaft to produce a first valve lift profile. The other latch pin position may provide a configuration in which the rocker arm assembly is operative to actuate the moveable valve in response to rotation of the camshaft to produce a second valve lift profile, which is distinct from the first valve lift profile, or the moveable valve may be deactivated.

Using electromechanical latch assemblies instead of hydraulically-actuated latches can reduce complexity and demands for oil in some valvetrain systems. Mounting the electromagnet on a part that is distinct from the rocker arm avoids running wires to the rocker arm. Rocker arms reciprocate rapidly over a prolonged period and in proximity to other moving parts. Wires attaching to a rocker arm could be caught, clipped, or fatigued and consequently short out.

According to some aspects of the present teachings, the electromagnet is operative to cause the latch pin to translate between the first and second positions through magnetic flux following a magnetic circuit that passes through the actuator and the rocker arm. In some of these teachings, the magnetic circuit also passes through the latch pin. In an alternative teaching, rather than passing through the latch pin, the magnetic circuit passes through another part that is mounted on the rocker arm and is positioned to act against the latch pin. The magnetic flux may be generated by the electromagnet and/or one or more permanent magnets. In some of these teachings, the electromagnet is operative to actuate the latch pin by generating, or ceasing to generate, the flux. In some of these teachings, the electromagnet is operative to actuate the latch pin by diverting the flux. Structuring the latch assembly to make the actuator operable through a magnetic circuit that brings magnetic flux into the latch pin or a co-acting part within the rocker arm enables the latch assembly to have a compact design suitable for packaging within the limited space available under a valve cover.

According to some aspects of the present teachings, the electromagnet is mounted in a position such that a line oriented in the direction along which the latch pin translates between its first and second positions and passing through the latch pin while the cam is on base circle will not intersect the electromagnet or the space it encircles. This condition may be satisfied regardless of the cam position and characterizes a freedom of electromagnet positioning enabled by applying a magnetic circuit concept according to the present teachings. In some of these teachings, a load-bearing member of the valvetrain completes the magnetic circuit.

In some of these teachings, the electromagnet, a permanent magnet, or a combination of one or more electromagnets and permanent magnets are positioned and functional to provide a magnetic field effective to hold the latch pin in at least one of the first and second positions through magnetic flux that follows the magnetic circuit. In some of these teachings, the electromagnet is operable to alter the magnetic flux in the circuit and thereby cause the latch pin to translate between the first and second positions.

In some of these teachings, the actuator is operative to change a magnetic force on the latch pin or an abutting part mounted on the rocker arm. In some of these teachings, the actuator is operative to change a magnetic force on the latch pin. The part on which the magnetic force acts is magnetized. The change in magnetic force may include the application of the magnetic force or the removal of the magnetic force. In some of these teachings, the change in magnetic force includes a reversal of a direction in which magnetic force acts on the part.

In some of these teachings, the magnetic circuit includes the latch pin or an abutting part mounted on the rocker arm. In some of these teaching, the magnetic circuit includes the latch pin. In some of these teaching, all or a portion of the part included in the magnetic circuit is formed of a magnetically susceptible material that if replaced with aluminum would render the electromagnet inoperative to cause the latch pin to translate between the first and second positions. In some of these teachings, the magnetically susceptible material is a low coercivity ferromagnetic material. Making a permanent magnet a part of the latch pin could undesirably increase the weight of the latch pin.

An operative portion of the magnetic flux may simply pass through the volume of the rocker arm. In some of these teachings, the magnetic circuit includes the structure of the rocker arm. All or part of the rocker arm may be formed of magnetically susceptible material. In some of these teachings, the rocker arm is formed primarily or entirely of low coercivity ferromagnetic material. In some of these teachings, the magnetic flux passes through a pole piece fixed to the core structure of the rocker arm. In some of these teachings, the rocker arm includes magnetically susceptible material that if replaced by aluminum would render the electromagnet inoperative to cause the latch pin to translate between the first and second positions.

In some of these teachings, magnetic flux following the magnetic circuit in one of a forward and a reverse direction enters the latch pin crossing directly or across an air gap from a pole piece that is the rocker arm or is fixed to the rocker arm and leaves the latch pin crossing directly or across an air gap to a second pole piece. The second pole piece is not mounted on the rocker arm, whereby the rocker arm is operative to move independently from the second pole piece. In some of these teaching, the magnetic flux passes through the rocker arm to the latch pin and from the latch pin across a variable width air gap to a pole piece that is not mounted on the rocker arm. The width of the air gap varies as the latch pin translates between the first and second positions. In some of these teachings, the width of the air gap also varies as the rocker arm pivots during operation of the rocker arm assembly. The pole piece that is not mounted on the rocker arm may be in a fixed position relative to the electromagnet. The term pole piece as used herein may encompass any structure that completes a magnetic circuit regardless of the position of the pole piece within the magnetic circuit. The structures determining these flux paths relate to a compact design. In some of these teachings, the electromagnet includes a coil around a solid immovable core. That core may be considered a pole piece.

In some of these teachings, the valvetrain is installed in an engine having a cylinder head and one or more parts including a valve cover that define the limits of an enclosed space underneath the valve cover. In some of these teachings, the parts of the engine along the shortest path between the latch pin and the nearest outer edge of that enclosed space consist essentially of one or more pole pieces that complete the magnetic circuit. The outer edge may be defined by the cylinder head. The latch pin may extend outward from the back of the rocker arm assembly and there may be only a relatively narrow gap between the rocker arm assembly and the cylinder head. The electromagnet may be too large to fit within that gap, however, the gap may accommodate a pole piece that may complete a magnetic circuit with the latch pin and the electromagnet.

In some aspects of the present teachings, the magnetic flux passes through a pivot for the rocker arm assembly. The pivot may provide a fulcrum for the rocker arm. Passing the flux through the pivot may provide a pathway through which the flux may be brought close to the latch pin or a co-acting part at a location within the rocker arm. In some of these teachings, the magnetic flux passes through the structure of the pivot. In some of these teachings, the pivot structure forms part of a magnetic circuit through which the actuator operates such that replacing that structure with aluminum would render the electromagnet inoperative to cause the latch pin to translate between the first and second positions. In some of these teachings, the pivot is made primarily of low coercivity ferromagnetic material. In some of these teachings, the pivot is a lash adjuster. In some of these teachings, the pivot is a hydraulic lash adjuster. The pivot may be relatively stationary compared to the rocker arm and flux from the actuator may be transferred to the pivot relatively easily. In some of these teachings, the electromagnet is mounted to the pivot. This structure may facilitate packaging and allow a structure through which the electromagnet is mounted to also provide a pole piece for the magnetic circuit.

In some aspects of the present teachings, there are two of the rocker arm assemblies and two of the latch pins and the electromagnet is operable to simultaneously cause both latch pins to translate between first and second positions. In some of these teachings, the two latch pins form parts of a single magnetic circuit for the electromagnet. In some of these teachings, the two rocker arm assemblies are side-by-side. In some of these teachings, the electromagnet is located between the two rocker arm assemblies. In some of these teachings, the electromagnet is mounted on a bracket supported by two lash adjusters, one associated with each of the two rocker arm assemblies. In some of these teachings, the magnetic circuit further includes two lash adjusters, one associated with each of the two rocker arm assemblies. In some of these teachings, the electromagnet is mounted on a bracket supported by four lash adjuster, each associated with a distinct rocker arm assembly. In some of these teachings, two lash adjusters to which the actuator is mounted are canted with respect to one another, whereby a mounting frame for the actuator that encircles both lash adjusters cannot slide freely upward and downward without interference.

In some of the present teachings, the valvetrain is installed within an engine having a combustion chamber and the electromagnet of the actuator is mounted in a position that is fixed with respect to the combustion chamber. In some of these teachings, the electromagnet is mounted to a cylinder head, a cam carrier, a camshaft journal, or a valve cover of the engine. In some of these teachings, the electromagnet is mounted to the outer shell of one or more lash adjusters. Mounting the electromagnet to a part that is distinct from the rocker arm and that is not constrained to move with the rocker arm allows wires powering the electromagnet to be maintained in relatively static positions.

In some of the present teachings, the actuator is operative to cause the latch pin to actuate through a magnetic field that crosses an air gap between the latch pin and an actuator part, which is a part that is not mounted on the rocker arm. In some of these teachings, the electromagnet is operative to generate the magnetic field. In some of these teachings, a permanent magnet generates the magnetic field. The actuator may be operative to redirect flux from the permanent magnet and thereby cause the latch pin to actuate.

In some of the present teachings, the rocker arm assembly and the latch assembly are structured to stably maintain the latch pin position in each of its first and second positions independently from the electromagnet. Stabilizing forces may be provided by springs, by permanent magnets, or a combination of springs and permanent magnets. The actuator may be operative to actuate the latch pin either way between the first and the second position. In some of these teachings, the internal combustion engine has circuitry operable to energize the electromagnet with a DC current in either a first direction or a reverse of the first direction. The electromagnet powered with current in the first direction maybe operative to actuate the latch pin from the first position to the second position. The electromagnet powered with current in the reverse direction may be operative to actuate the latch pin from the second position to the first position. In some others of these teachings, the actuator includes two electromagnets, one for latching and the other for unlatching. The two electromagnets may have windings in opposite directions.

In some of the present teachings, a permanent magnet is operative to stabilize the latch pin in both the first and second positions. In some of these teachings, the permanent magnet is mounted to the rocker arm. In some others of these teachings, the permanent magnet is part of the actuator. In some of these teachings, absent any magnetic fields generated by the electromagnet or other external sources, when the latch pin is in the first position, an operative portion of the magnetic flux from the permanent magnet follows a first magnetic circuit and when the latch pin is in the second position, an operative portion of the magnetic flux from the permanent magnet follows a second magnetic circuit distinct from the first magnetic circuit. The actuator may be operative to redirect the permanent magnet's flux away or toward one or the other of these magnetic circuits and thereby cause the latch pin to actuate. In some of these teachings redirecting the magnetic flux includes reversing the magnetic polarity in a low coercivity ferromagnetic element forming part of both the first and second magnetic circuits. A latch assembly operating with a flux-shifting mechanism may be made compact and thus more suitable for installation within an engine.

In some of these teachings, at least one of the magnetic circuits passes through the actuator. A magnetic circuit passing through the actuator may facilitate actuation of the latch pin though operation of the electromagnet. In some of these teachings, the other circuit does not pass through the actuator. The circuit not passing through the electromagnet may be much shorter, have lower magnetic flux leakage, and allow the permanent magnet to apply a greater holding force to the latch pin.

In some of these teachings, the latch assembly comprises two permanent magnets, both of which are operative to stabilize the latch pin in both the first and the second positions. The second permanent magnet may be mounted to the rocker arm or the actuator. When the latch pin is in the first position, an operative portion of the magnetic flux from the second permanent magnet follows a third magnetic circuit and when the latch pin is in the second position, an operative portion of the magnetic flux from the permanent magnet follows a fourth magnetic circuit distinct from the third magnetic circuit. The electromagnet may be operative to redirect the second permanent magnet's flux away or toward one or the other of these magnetic circuits and thereby cause the latch pin to actuate. In some of these teachings, one of the third and fourth circuits passes through the actuator and the other does not. In each of the latch pin positions, one of the active magnetic circuits may provide a short flux path that results in a high holding force on the latch pin and the other magnetic circuit may pass through the electromagnet and facilitate actuation of the latch pin though operation of the electromagnet.

In some of the present teachings, the latch pin is mounted on a rocker arm of the rocker arm assembly and, along with the rocker arm, has a range of motion relative to the actuator. An air gap in a magnetic circuit through which the actuator operates on the latch pin may vary in width in conjunction with this relative motion. The rocker arm position and thus the air gap width may be affected at times by the position of the cam. In some of these teachings, the rocker arm assembly and the latch assembly are configured such that the actuator does not need to be operative on the latch pin except within a limited portion of rocker arm's range of motion. Actuation of the latch pin may occur only when the cam is on base circle.

In some of these teachings, the rocker arm assembly is configured whereby the rocker arm to which the latch pin is mounted remains substantially stationary when the latch pin is in a non-engaging configuration. The engaging configuration may be maintained independently from the actuator. In some of these teachings, the engaging configuration is maintained by a spring. If the actuator need only be operative on the latch pin when the rocker arm is in one particular position, a structure providing a low reluctance magnetic circuit that enables the actuator's operability is more easily achieved. In some of these teachings, in the engaging configuration, with each cycle of the cam the rocker arm reaches a position in which the actuator is operative to induce a magnetic force on the latch pin sufficient to overcome the spring force and hold the latch pin in the non-engaging configuration. The actuator need not be so operative throughout the cam cycle.

In some of the present teachings, the rocker arm to which the latch pin is mounted has a range of motion and the operability of the actuator is maintained throughout that range of motion by one or more sliding joints in the magnetic circuit. In some of these teachings, one part of the sliding magnetic joint is a pole piece held in a fixed position with respect to the actuator and the other is part of the latch pin. In some of these teachings, one part of the sliding magnetic joint is a pole piece held in a fixed position with respect to the actuator and the other is the rocker arm to which the latch pin is mounted or a pole piece fixed to that rocker arm.

In some of the present teachings, first pole piece moves in conjunction with the rocker arm, a second pole piece remains stationary with respect to the actuator, and one of the first and second components has a surface extending along the direction in which the first component moves relative to the second component. This structure may form a sliding magnetic joint and allow the first and second components to remain proximate as the rocker arm travels through its range of motion. In some of these teachings, both pole pieces have surfaces extending along the direction of relative motion. Providing both pole pieces with surfaces extending along the direction of relative motion may maintain proximity between the two components and provide a large area through which magnetic flux may easily pass between them.

In some of these teachings, the latch pin has a pole piece an outer portion of which traces an arc as the rocker arm moves through its range of motion and the actuator has a pole piece with a surface parallel to the arc and positioned to remain in proximity to the arc throughout the rocker arm's range of motion. The two components may form a sliding magnetic joint for the magnetic circuit. In some of these teachings, the actuator includes one or more pole pieces extending proximate a side of the rocker arm to form a sliding magnetic joint. In some of these teachings, the actuator includes a pole pieces extending proximate a side of the latch pin where the latch pin extends outward from the rocker arm. The effectiveness of the actuator may depend on its positioning relative to the rocker arm. The effect of variations in that positioning due to lash adjustment and manufacturing tolerances may be ameliorated by one or more sliding magnetic joints.

In some of the present teachings, the latch pin is mounted to a first rocker arm and a second rocker arm passes between the first rocker arm and the actuator over the course of the second rocker arm's range of motion. Nevertheless, a magnetic circuit that passes between the actuator and the latch pin may be formed. Moreover, in some of these teachings, the magnetic circuit may be maintained and stabilize the latch pin position throughout the second rocker arm's range of motion. In some of these teachings, pole pieces are mounted to the second rocker arm that complete a magnetic circuit that includes the latch pin and the actuator. In some of these teachings, pole pieces mounted to either the actuator or the first rocker arm pass around the second rocker arm to complete the magnetic circuit.

Some aspects of the present teachings provide a module for installation in an engine. The module includes a rocker arm assembly, a lash adjuster, and an actuator according to the present teachings. In some of these teachings, the lash adjuster is secured to the rocker arm assembly. The module may be convenient for installation in an engine and may facilitate correct positioning of the actuator relative to the rocker arm. A connecting piece that secures the lash adjuster to the rocker arm assembly prior to installation may be removed after installation.

Some aspects of the present teachings relate to methods of operating an internal combustion engine. In some of these teachings, the engine includes a valvetrain in which a rocker arm assembly has a latch pin mounted to a rocker arm. The latch pin provides the rocker arm assembly with engaging and non-engaging configurations. According to some aspects of the present teachings, a method of operating the engine includes operating the engine with the latch pin in one of the engaging and non-engaging configurations. An electromagnet of an actuator that is mounted within the engine but on a component distinct from the rocker arm is energized to cause magnetic flux to pass through the rocker arm. The magnetic flux passing through the rocker arm causes the latch pin to translate and thereby changes the rocker arm assembly configuration. The engine is then further operated with the rocker arm assembly in the other of the engaging and non-engaging configurations. In some of these teaching, the latch pin is actuated by magnetic flux that passes through the structure of the rocker arm. In some of these teaching, the latch pin is actuated by magnetic flux that passes through the structure of a pivot that provides a fulcrum on which the rocker arm pivots.

Some aspects of the present teachings relate to a method of operating an internal combustion engine in which an electrical circuit that includes an electromagnet operative to actuate a rocker arm-mounted latch pin is used to provide rocker arm position information. Rocker arm position may be related to camshaft position. Accordingly, the data may be interpreted to provide camshaft position information. The information may be used to perform an engine management or diagnostic operation. The method is applicable to an internal combustion engine that includes a combustion chamber, a moveable valve having a seat formed in the combustion chamber, a camshaft on which a cam is mounted, a rocker arm assembly including a rocker arm and a cam follower configured to engage the cam as the camshaft rotates, and a latch assembly including a latch pin mounted on the rocker arm and an actuator that includes an electromagnet. The actuator parts are need not be mounted on the rocker arm, whereby the rocker arm with the latch pin may move independently from the actuator. The electromagnet is operative to cause the latch pin to translate between the first and the second position through magnetic flux that follows a magnetic circuit that passes through the latch pin and includes an air gap between the latch pin and a pole piece of the actuator. The pole piece is mounted on a part distinct from the rocker arm. The rocker arm assembly and the latch assembly are structured such that the air gap varies in width in relation to a motion of the rocker arm that actuates the moveable valve. The method includes analyzing data relating to a current or voltage in an electrical circuit comprising the electromagnet to obtain rocker arm position information, and using the information in an operation. The data is obtained while the engine is operating and the camshaft is rotating. Analyzing the data may also provide latch pin position information, which may also be used in an engine management or diagnostic operation.

In some of these teachings, the rocker arm or cam shaft position information is used to manage the engine. Managing the engine may include regulating an ignition timing or a fueling event. In some of these teachings, the latch assembly replaces a cam position sensor in engine management operations. In some of these teachings, two or more of the latch assemblies are used to serve the purpose a cam position sensor. Obtaining data from more than one latch assembly allows for a more accurate determination of cam position.

In some of these teachings, the information is used to perform a diagnostic. Performing a diagnostic may include reporting a diagnostic result. In some of these teachings, if the rocker arm assembly is operating correctly, the rocker arm on which the latch pin is mounted will go through a first range of motion if the latch pin is in the engaging position and remain stationary or go through a second range of motion that is distinct from the first if the latch pin is in the non-engaging position. The air gap width will depend on the rocker arm position. As the air gap varies in width, the magnetic reluctance of the magnetic circuit and the inductance of the electromagnet will also vary. The inductance will be reflected in the current or voltage data, allowing the rocker arm position to be determined. In some of these teachings, the data over a span of time is analyzed to diagnose rocker arm motion. These methods allow the same electromagnet that is used to actuate the latch pin to also provide on-board diagnostic (OBD) information or to be used for engine management.

In some of these teachings, a circuit including the electromagnet is powered to facilitate gathering the data used to obtain rocker arm position information. In some of these teachings, the electrical circuit is given a pulse insufficient to actuate the latch pin and the data relates to a current or voltage induced by the pulse. In some of these teachings, gathering the data comprises gathering the data over a cam cycle through which the electrical circuit is continuously powered with a current that does not maintain or affect the latch pin position. In some of these teachings, the electromagnet is powered with a DC current to actuate the latch pin and is powered with an AC current while gathering the data. The AC current need not affect the latch pin position. The AC signal may be driven on top of the DC current.

In some of these teachings, the information is used to determine whether an event referred to as a "critical shift" has occurred. A critical shift is an event in which a latch pin slips out of engagement while the cam is lifting a rocker arm. When this happens, the rocker arm to which the latch pin is mounted rapidly returns to the position normally associated with base circle. A time variation of a current within the circuit comprising the electromagnet or an absolute value of that current at a particular time may be used to determine whether a critical shift has taken place.

A method in accordance with some other aspects of the present teachings relates to the case in which the latch pin is stable in both engaging and non-engaging positions. In this method, the engine is operated while using a permanent magnet to maintain the latch pin in the engaging position. An electromagnet that is mounted on a part distinct from the rocker arm is energized to redirect magnetic flux from the magnet and cause the latch pin to switch to a non-engaging position. The engine is then further operated with the permanent magnet maintaining the latch pin in the non-engaging position. In some of these teachings, the electromagnet is subsequently energized with a current in the reverse direction to again redirect the magnetic flux from the magnet and cause the latch pin to switch back to the engaging position.

In some of the present teachings, the rocker arm to which the latch pin is mounted is of a design that was put into production for use with a hydraulically actuated latch. In some of these teachings, the rocker arm to which the latch pin is mounted includes a hydraulic chamber adapted to receive a hydraulically actuated latch pin. In some of these teachings, a magnetically actuated latch pin is installed in that hydraulic chamber. Rocker arms for commercial applications are typically manufactured using customized casting and stamping equipment requiring a large capital investment. The present disclosure provides designs that allow these same rocker arms to be used with a magnetically actuated latch pin.

Some aspects of the present teachings relate to a method of retrofitting for electromagnetic latching a rocker arm manufactured for hydraulic latching. The method includes installing a latch pin within a hydraulic chamber of the rocker arm with a portion of the latch pin protruding from the chamber. The rocker arm is installed within an engine in a magnetic circuit in which flux from an electromagnet in one of a North to South or South to North direction will enter the latch pin through the rocker arm and leave the rocker arm across an air gap between the protruding portion of the latch pin and a pole piece of the latch assembly.

The primary purpose of this summary has been to present certain of the inventors' concepts in a simplified form to facilitate understanding of the more detailed description that follows. This summary is not a comprehensive description of every one of the inventors' concepts or every combination of the inventors' concepts that can be considered "invention". Other concepts of the inventors will be conveyed to one of ordinary skill in the art by the following detailed description together with the drawings. The specifics disclosed herein may be generalized, narrowed, and combined in various ways with the ultimate statement of what the inventors claim as their invention being reserved for the claims that follow.

DETAILED DESCRIPTION

Figure 1A:
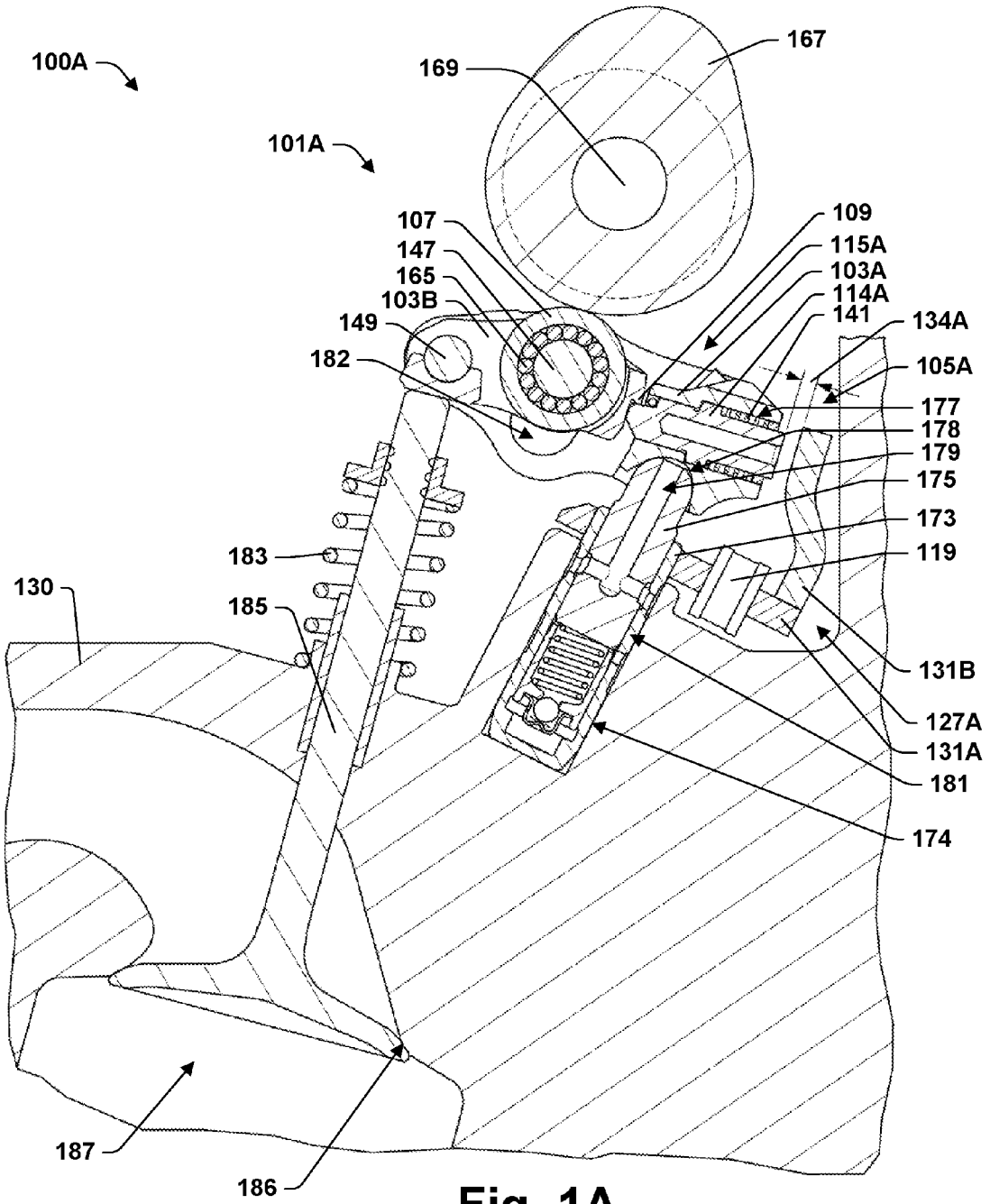
FIG. 1A is a partial cross-section of an internal combustion engine with a valvetrain according to some aspects of the present teachings.

In the drawings, some reference characters consist of a number followed by a letter. In this description and the claims that follow, a reference character consisting of that same number without a letter is equivalent to a listing of all reference characters used in the drawings and consisting of that same number followed by a letter. For example, "permanent magnet 200" is the same as "permanent magnet 200A, 200B, 200C".

FIG. 1A provides a partial-cutaway side view of a portion of an engine 100A including a valvetrain 101A in accordance with some aspects of the present. Engine 100A includes a cylinder head 130 in which a combustion chamber 137 is formed, a moveable valve 185 having a seat 186 formed within combustion chamber 137, and a camshaft 169 on which a cam 167 is mounted. Moveable valve 185 may be a poppet valve. Valvetrain 101A includes rocker arm assembly 115A, hydraulic lash adjuster (HLA) 181, and latch assembly 105A. Rocker arm assembly 115A includes rocker arm 103A (an outer arm) and rocker arm 103B (an inner arm). HLA 181 is an example of a pivot. It provides a fulcrum on which rocker arm 103A pivots. A pivot may alternatively be a mechanical lash adjuster, a post that provides a fulcrum on which a rocker arm pivots, or a rocker shaft. Outer arm 103A and inner arm 103B are pivotally connect through shaft 149. A cam follower 107 may be mounted to inner arm 103B through bearings 165 and shaft 147. Cam follower 107 is configured to engage cam 167 as camshaft 169 rotates. Cam follower 107 is a roller follower but could alternatively be another type of cam follower such as a slider.

Shaft 147 protrudes outward through openings 182 in the sides of outer arm 103A where it engages torsion springs 145 (see FIG. 2A), which are mounted to outer arm 103A. If inner arm 103B pivots downward relative to outer arm 103A on shaft 149 as shown in FIG. 1 D, torsion springs 145 act on shaft 147 to drive inner arm 103B to pivot back toward the position shown in FIG. 1A.

Latch assembly 105A includes an actuator 127A mounted to HLA 181 and a latch pin 114A mounted on rocker arm 103A. In this specification, the terms "latch pin" and "rocker arm" encompass the most basic structure that would be commonly understood as constituting a "latch pin" or a "rocker arm" and may further encompass parts that are rigid and rigidly held to that most basic structure. A rocker arm assembly is operative to form one or more force transmission pathways between a cam and a moveable valve. A rocker arm is a lever operative to transmits force from the cam along one or more of those pathways. The most basic structure of the rocker arm, which is its core structure, is capable of bearing the load and carrying out that function.

Figure 1B:
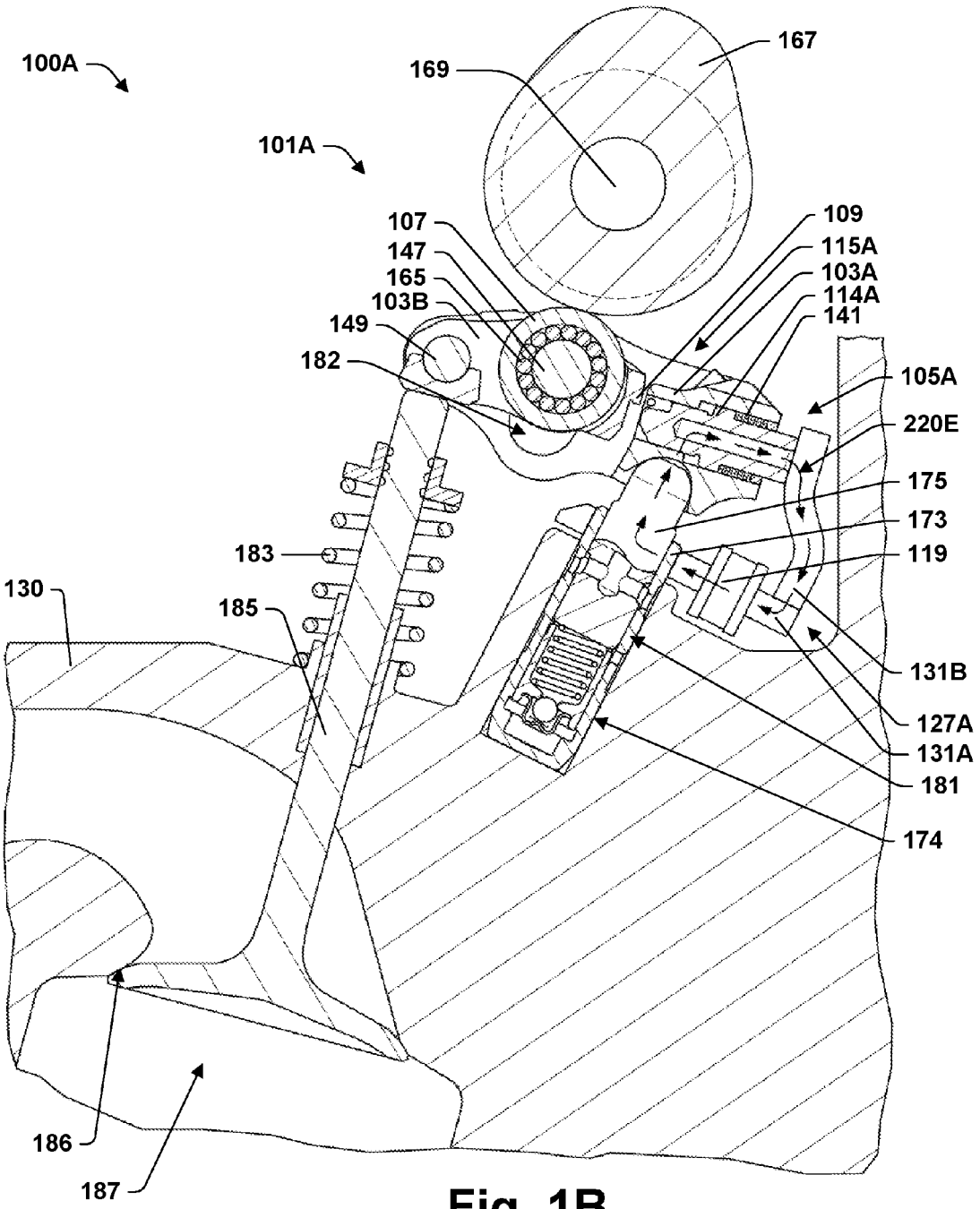
FIG. 1B is the same view as FIG. 1A, but with the latch pin moved from an engaging to a non-engaging position.

Latch pin 114A is translatable between a first position and a second position. The first position may be an engaging position, which is illustrated in FIG. 1A. The second position may be a non-engaging position, which is illustrated in FIG. 1B. A spring 141 mounted within outer arm 103A may be configured to bias latch pin 114A into the engaging position. When latch pin 114A is in the engaging position, rocker arm assembly 115A may be described as being in an engaging configuration. When latch pin 114A is in the non-engaging position, rocker arm assembly 115A may be described as being in a non-engaging configuration.

Figure 1C:
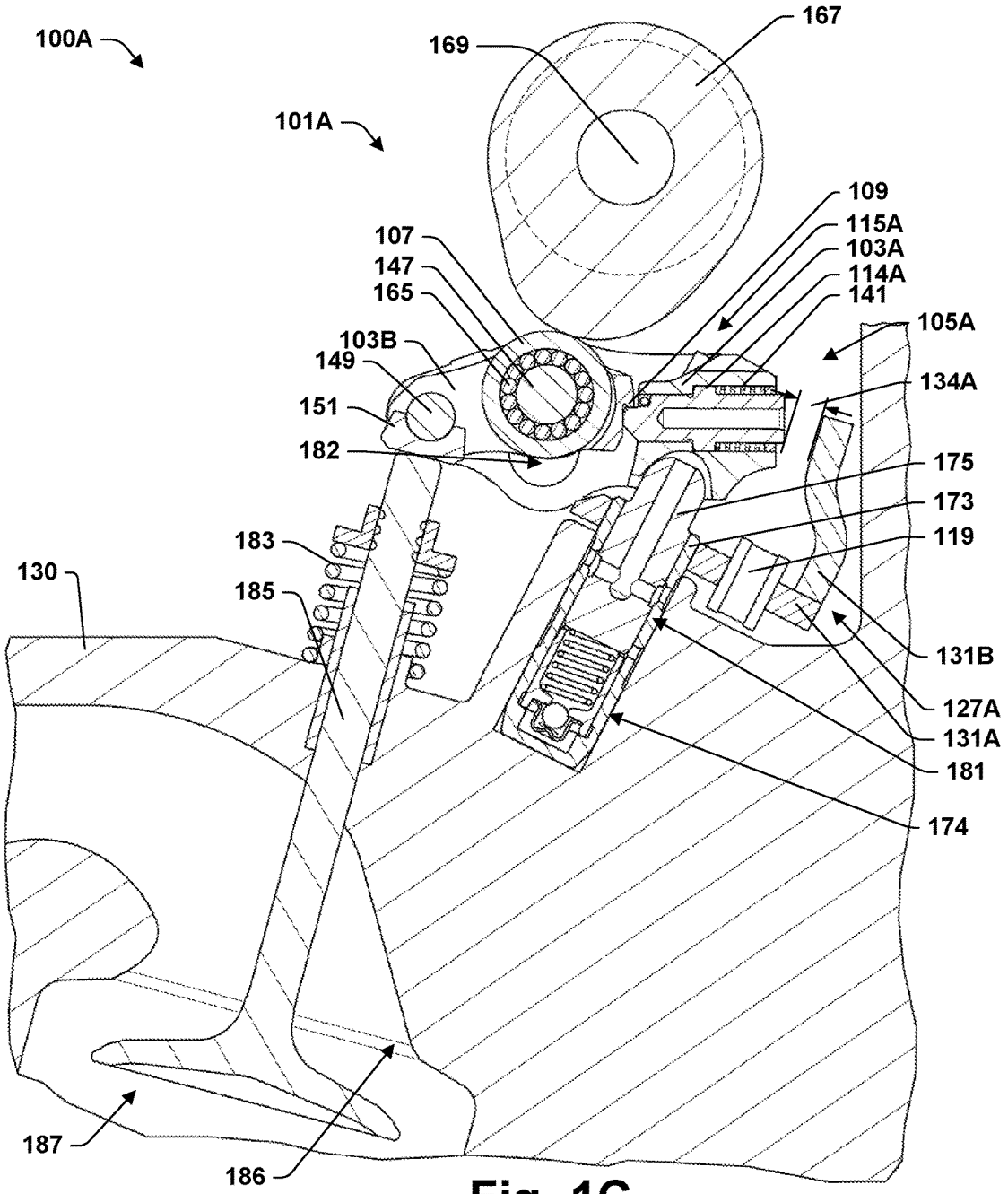
FIG. 1C is the same view as FIG. 1A, but with the cam risen off base circle.

FIG. 1C shows the effect if cam 167 rises off of base circle while latch pin 114A is in the engaging position. Latch pin 114A may engage lip 109 of inner arm 103B, after which inner arm 103B and outer arm 103A may be constrained to move in concert. HLA 181 may provide a fulcrum on which inner arm 103B and outer arm 103A pivot together as a unit, driving down on valve 185 via an elephant's foot 151, compressing valve spring 183 against cylinder head 130, and lifting valve 185 off its seat 186 within combustion chamber 137 with a valve lift profile determined by the shape of cam 167. The valve lift profile is the shape of a plot showing the height by which valve 185 is lifted of its seat 186 as a function of angular position of camshaft 169.

Figure 1D:
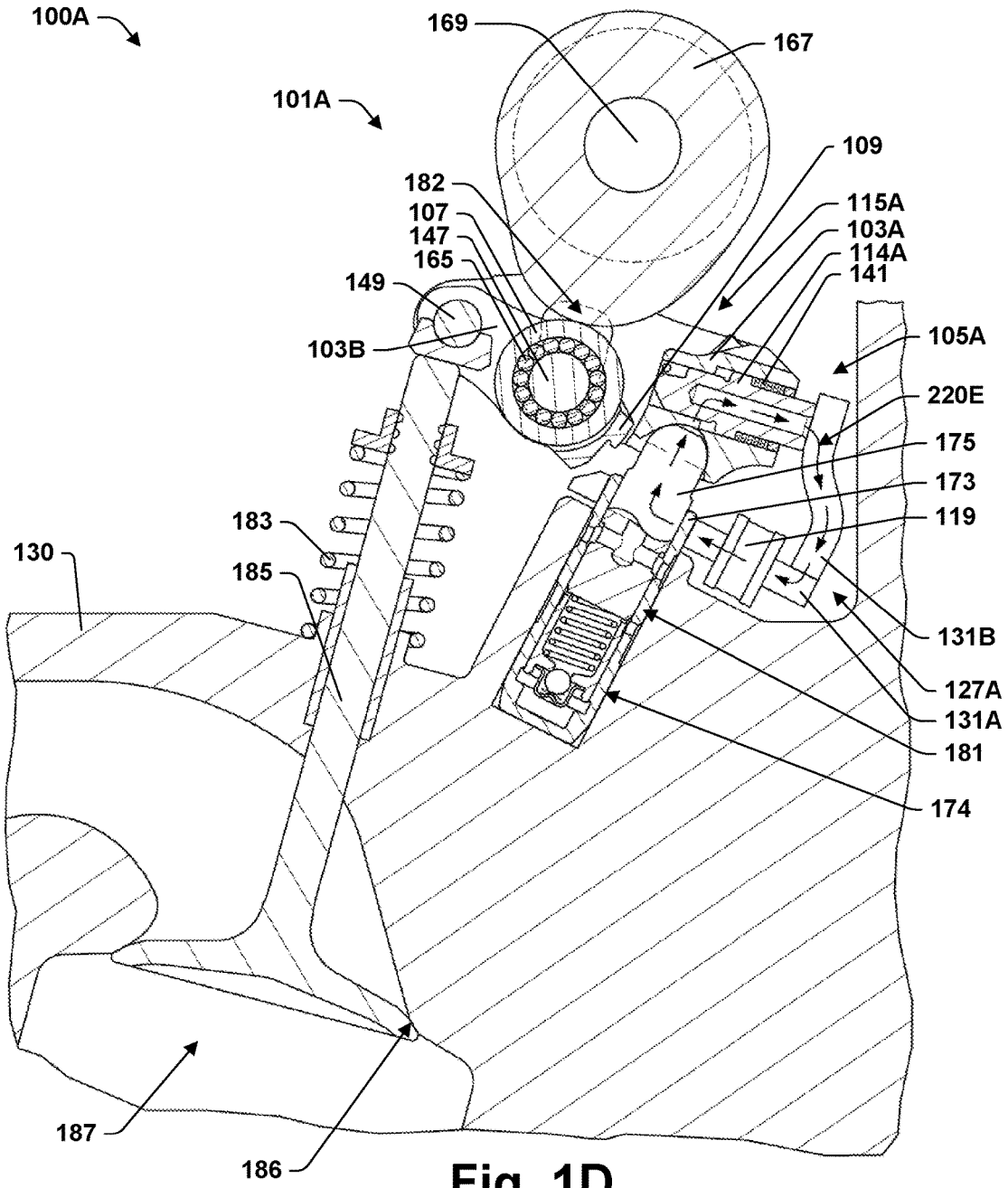
FIG. 1D is the same view as FIG. 1B, but with the cam risen off base circle.

FIG. 1D shows the effect if cam 167 rises off of base circle while latch pin 114A is in the non-engaging position. Cam 167 still drives inner arm 103B downward, but instead of compressing valve spring 183, inner arm 103B pivots on shaft 149 against the resistance of torsion springs 145. Torsion springs 145 yield more easily than valve spring 183. Outer arm 103A remains stationary and valve 185 remains on its seat 186. Accordingly, the non-engaging configuration may provide deactivation of a cylinder with a port controlled by valve 185. Alternatively, there may be additional cams that operate directly on outer arm 103A. These additional cams may provide a lower valve lift profile than cam 167. Therefore, the non-engaging configuration for rocker arm assembly 115A may provide an alternate valve lift profile and rocker arm assembly 115A may provide a switching rocker arm.

Actuator 127A may include an electromagnet 119 and pole pieces 131A and 131B. Actuator 127A is mounted to HLA 181 through pole piece 131A, which also provides a core for electromagnet 119. HLA 181 includes an inner sleeve 175 and an outer sleeve 173. Outer sleeve 173 is installed within a bore 174 formed in cylinder head 130. Outer sleeve 173 may rotate within bore 174, but is otherwise substantially stationary with respect to cylinder head 130. Inner sleeve 175 is telescopically engaged within outer sleeve 173 and provides a fulcrum on which outer arm 103A pivots. That fulcrum may be hydraulically raised or lowered to adjust lash.

Latch pin 114A, outer arm 103A, inner sleeve 175, and outer sleeve 173 may be made entirely of low coercivity ferromagnetic material. Together with pole pieces 131A and 131B, they may form a magnetic circuit 220E, which is shown in FIG. 1B. A magnetic circuit is a structure operative to be the pathway for an operative portion of the magnetic flux from a magnetic flux source. Magnetic circuit 220E provides a pathway for magnetic flux that is generated by electromagnet 119 and is operative to actuate latch pin 114A from its engaging to its non-engaging position. When electromagnet 119 is first energized, magnetic circuit 220E includes the air gap 134A, which is shown in FIG. 1A. Energizing electromagnet 119 generates magnetic flux that polarizes low coercivity ferromagnetic materials within circuit 220E and results in magnetic forces on latch pin 114A that tend to drive it to the non-engaging position shown in FIG. 1B. Driving latch pin 114A to the non-engaging configuration reduces air gap 134A and the magnetic reluctance in circuit 220E. If electromagnet 119 is switched off, spring 141 may drive latch pin 114A back into the engaging configuration and reopen air gap 134A.

Magnetic circuit 220E passes through rocker arm 103A. In this disclosure, "passing through" a part means passing through the smallest convex volume that can enclose the part. When asserting that a magnetic flux that is operative "passes through" a part, the meaning is that the entirety of a portion of the magnetic flux that is sufficient to be operative passes through that part. In other words, the operability is achieved independently from any flux that follows a circuit that does not pass through the part.

Magnetic circuit 220E passes through the structure of rocker arm 103A. "Passing through the structure" of a part means passing through the material that makes up that part. If the part forms a low reluctance pathway for the magnetic flux, it may help define the magnetic circuit. Low coercivity ferromagnetic materials in particular are useful in establishing magnetic circuits. In some cases, the magnetic properties of a part are essential to the formation of a magnetic circuit through which actuator 127 is operative. A touchstone for these cases is that if that part were replaced by an aluminum part, an operability dependent on that circuit would be lost. Aluminum is an example of a paramagnetic material. For the purposes of this disclosure, a paramagnetic material is one that does not interact strongly with magnetic fields.

Figure 22:
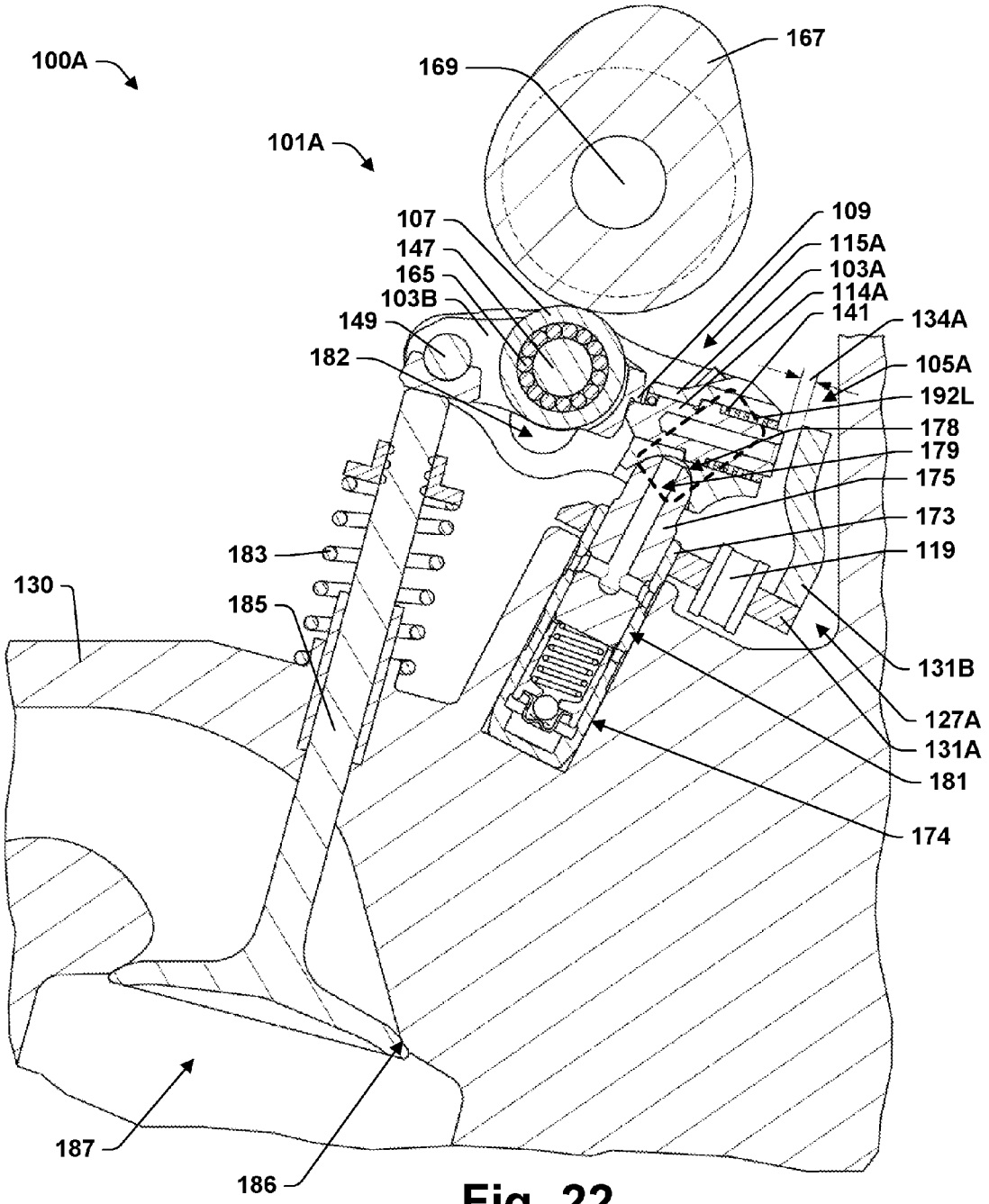
FIG. 22 illustrates a modification of the valvetrain in FIG. 1A according to some aspects of the present teachings.

HLA 181 and latch pin 114A form an essential part of magnetic circuit 220E. In other words, if either of these parts were replaced by ones made entirely of aluminum, actuator 127 would cease to be operative to actuate latch pin 114A. Depending on the strength of electromagnet 109, the core structure of rocker arm 103A may also form an essential part of magnetic circuit 220E. Rocker arm 103A may be formed of low coercivity ferromagnetic material that provides a low reluctance pathway for magnetic flux crossing from HLA 181 to latch pin 114A. On the other hand, HLA 181 brings magnetic flux sufficiently close to latch pin 114A that magnetic flux may cross between HLA 181 and latch pin 114A following magnetic circuit 220E regardless of the material in between. In some of these teachings, pole pieces 192L are positioned to the sides of rocker arm 103A as illustrated in FIG. 22 to facilitate transmission of magnetic flux from HLA 181 to latch pin 114A within rocker arm 103A.

Latch pin 114A, by virtue of being mounted to outer arm 103A, has a range of motion relative to combustion chamber 137 and actuator 127A. This range of motion may be primarily the result of outer arm 103A pivoting on HLA 181 when rocker arm assembly 115A is in the engaging configuration. On the other hand, the position of latch 117A relative to actuator 127A may be substantially fixed while latch 117A is in the non-engaging configuration. Extension and retraction of HLA 181 may introduce some relative motion but, excluding a brief period during start-up, the range of motion introduced by HLA 181 may be negligible. As long as latch pin 114A is in the non-engaging configuration, magnetic circuit 220E may remain operative whereby electromagnet 119 may act through that circuit to maintain latch pin 114A in the non-engaging configuration.

Figure 2A:
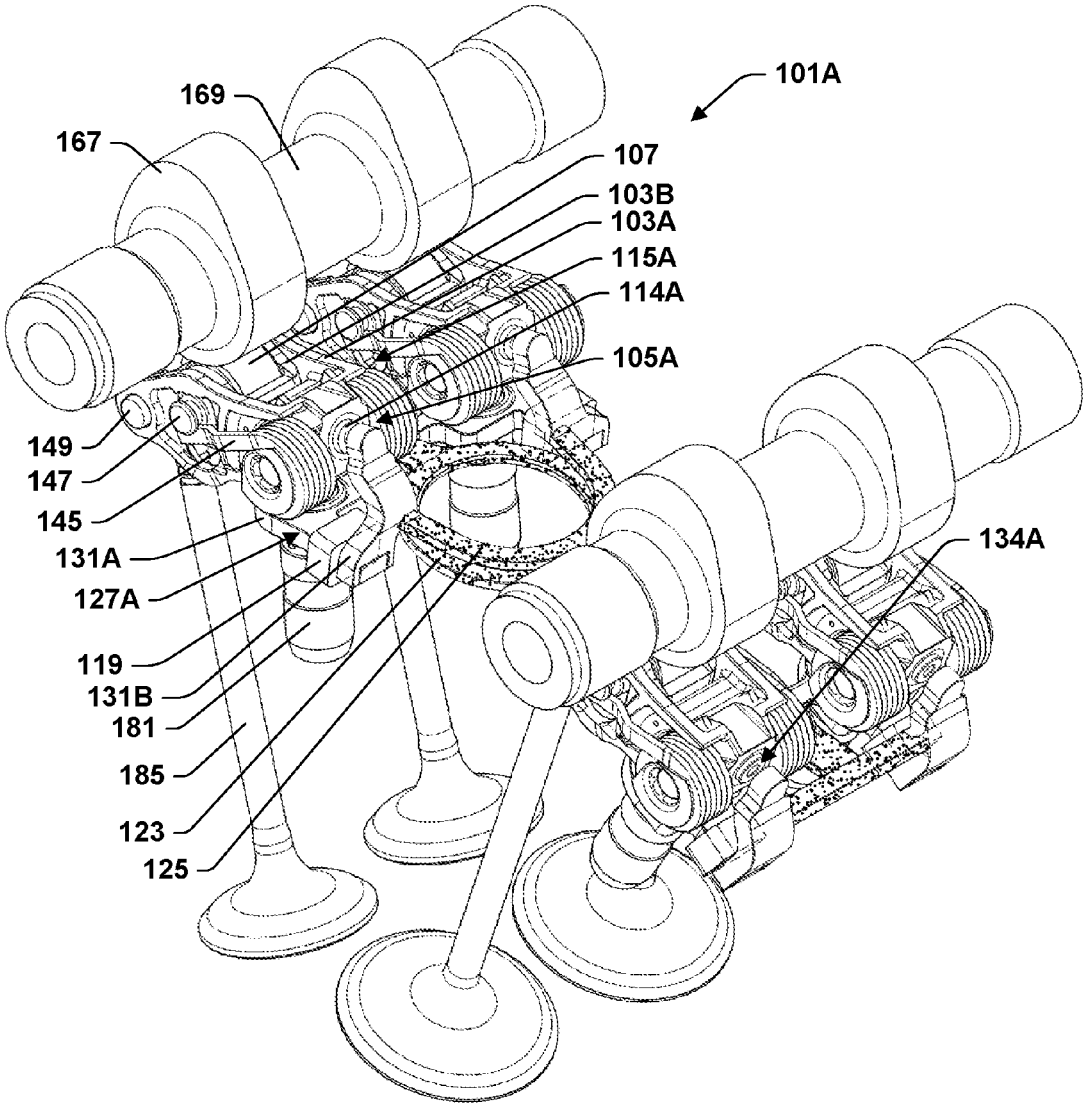
FIG. 2A provides a perspective view of a portion of the valvetrain of the engine illustrated by FIG. 1A.
Figure 2B:
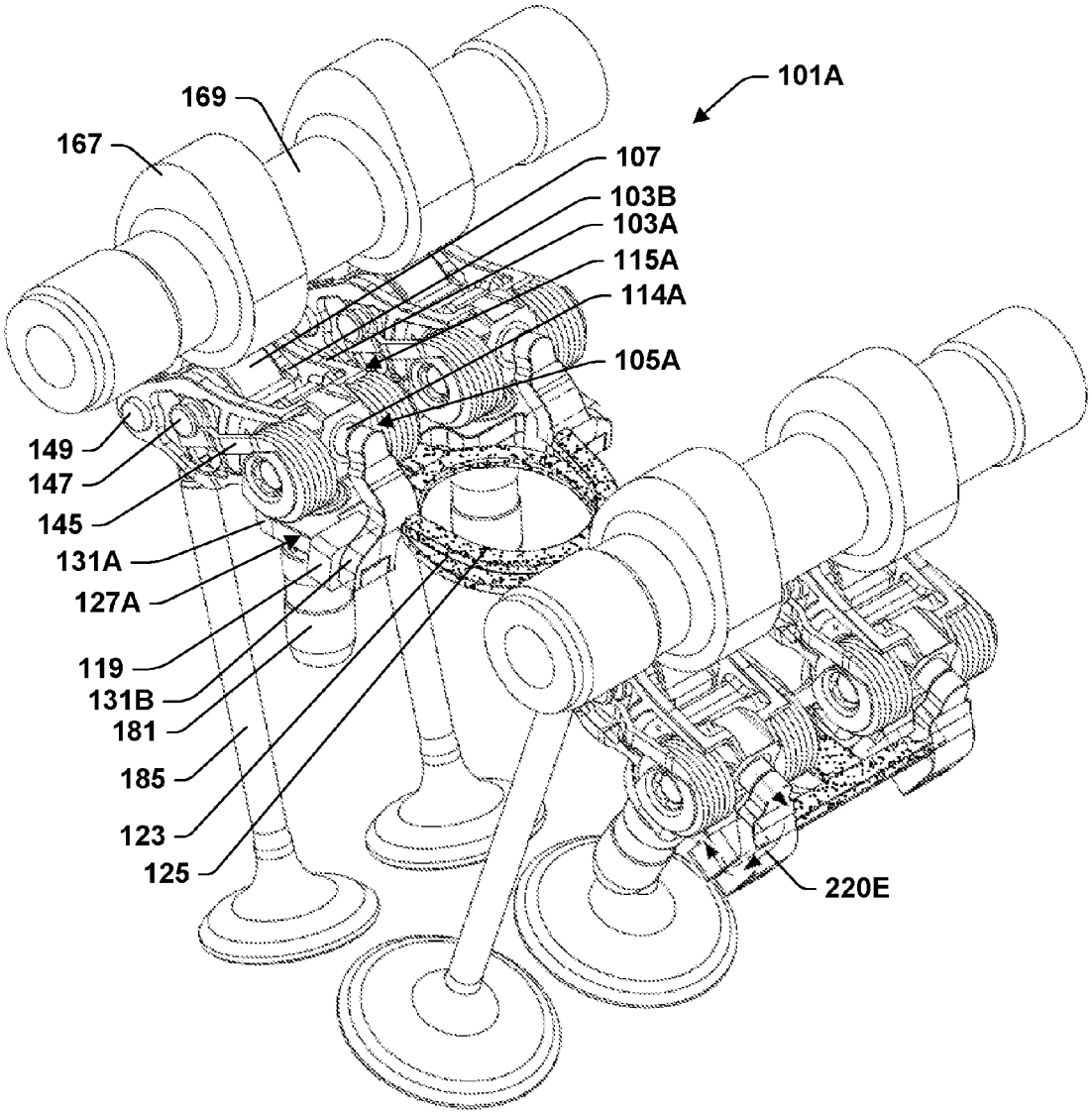
FIG. 2B provides the same view as FIG. 2A, but with the latch pins moved from engaging to non-engaging positions.

FIGS. 2A and 2B are perspective views of a portion of the valvetrain 101A, which is in accordance with some aspects of the present teachings and is a part of engine 100A. As shown by these illustrations, actuator 127A may be one of four supported by a common mounting frame 123. The four actuators 127A may control two intake ports and two exhausts ports for one engine cylinder. Mounting frame 123 may include four pole pieces 131A joined with a paramagnetic connecting structure 122.

Figure 3A:
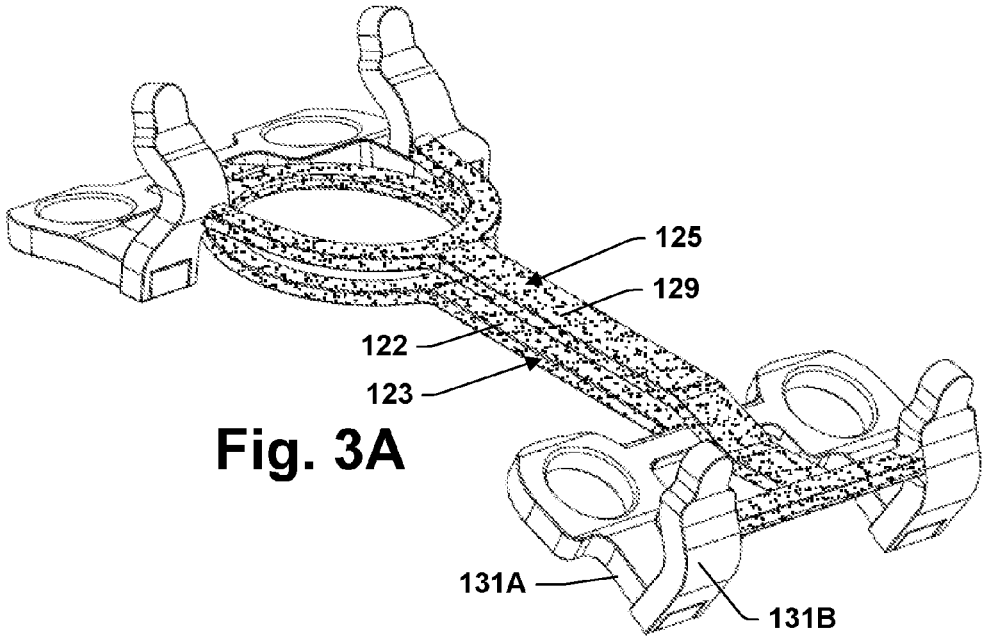
FIG. 3A provides a perspective view of an actuator mounting frame according to some aspects of the present teachings, which is used in the valvetrain of FIG. 2A.
Figure 3B:
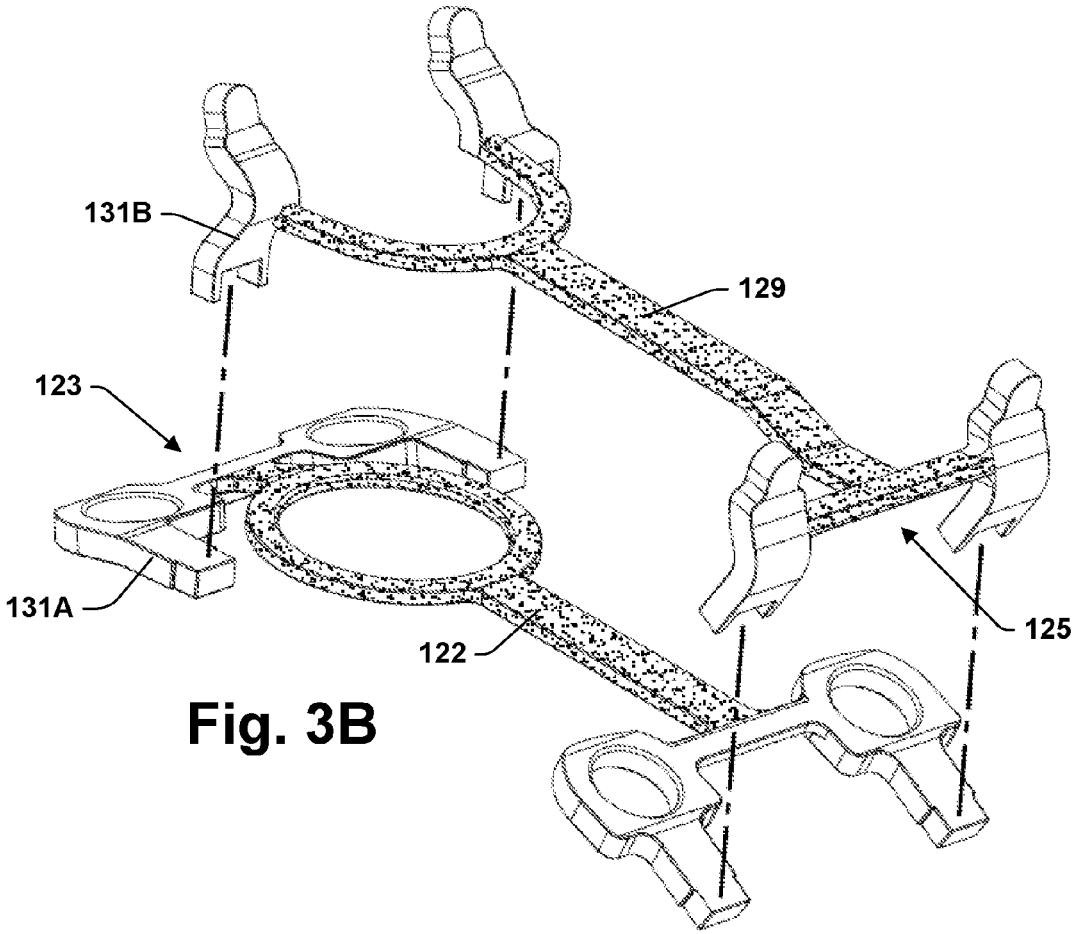
FIG. 3B provides an explode view of the mounting frame of FIG. 3A.
Figure 3C:
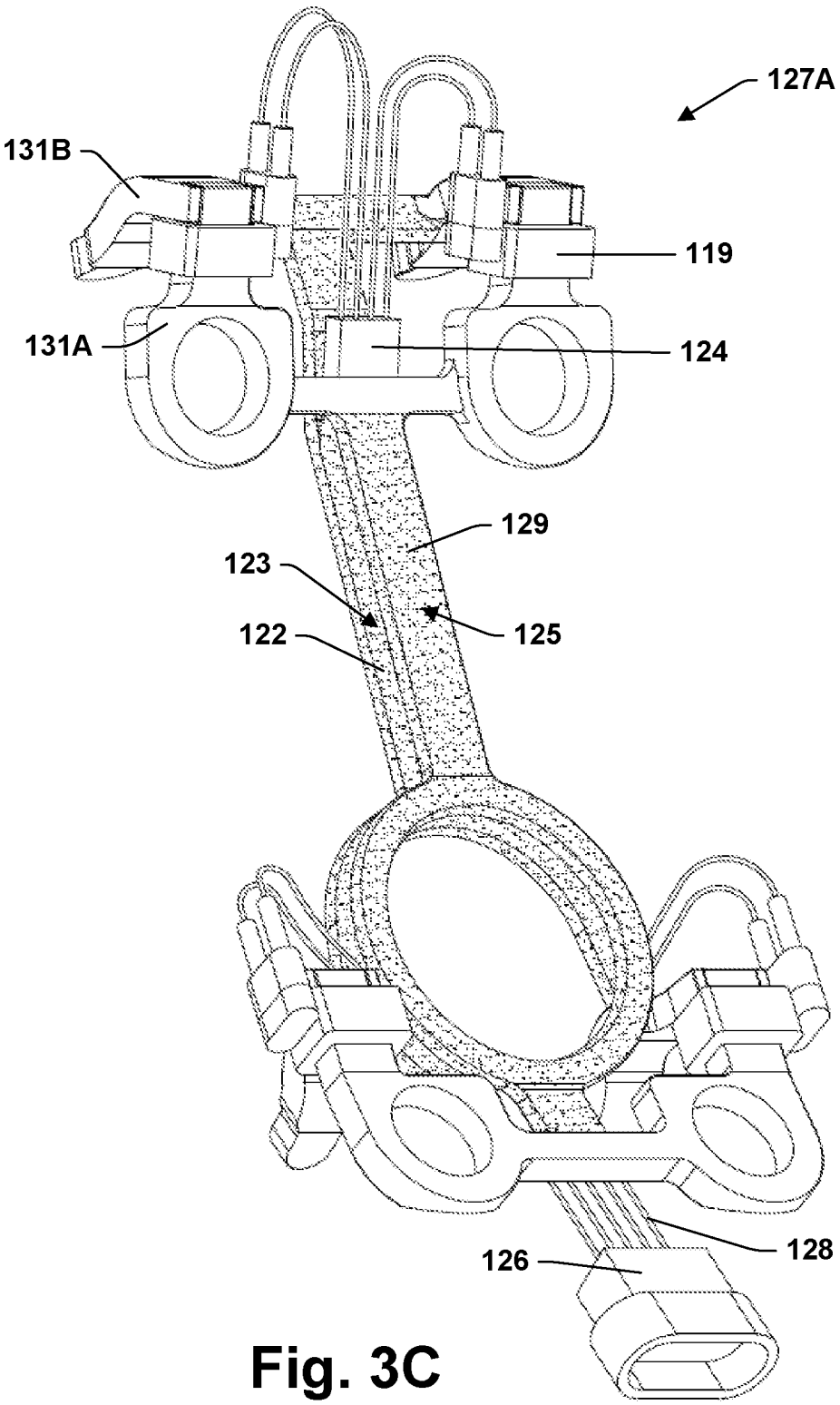
FIG. 3C provide a perspective view of four actuators 127A according to the present teachings incorporating the mounting frame of FIG. 3A.

As shown in FIGS. 3A-3C, mounting frame 123 may join with an upper frame 125 to support and protect a wiring harness 124. Wiring harness 124 includes wires 128 that provide power to electromagnets 119. Mounting frame 123 supports wiring harness 124 from below. Upper frame 125 may protect wires 128 from objects falling from above during manufacturing or maintenance. Upper frame 125 may include four pole pieces 131B and a paramagnetic connecting structure 129.

Wires 128 may all connect to a common plug 126. In some of these teachings, two of the electromagnets 119 are connected in series or in parallel. In some of these teachings, all four of the electromagnets 119 are connected in series or in parallel. These options reduce the number of wires in plug 126 and allowing a tradeoff between circuit costs and flexibility. For example, the intake and exhaust valves in a multi-valve engine may only be subject to deactivation in pairs.

In accordance with some of the present teachings, mounting frame 123 is supported to two or more HLAs 181 that are angled with respect to one another when installed in their bores 174. This angling may restrict vertical movement of mounting frame 123. Mounting frame 123 may not fit over HLAs 181. In an installation method, two or more HLAs 181 may be slid through openings in mounting frame 123 into their bores 174. Electromagnets 119 and wiring harness 124 may be installed on mounting frame 123 either before or after this operation. Upper frame 125 may be connected to mounting frame 123 any time after the installation of electromagnets 119. Mounting frame 123 may be further secured with connectors attaching frame 123 to cylinder head 130.

Mounting frame 123 may be part of a valve actuation module. In the present disclosure, a valve actuation module is a structure that includes a rocker arm assembly 115 and an actuator 127 according to the present disclosure. The actuator 127 may be mounted to a pivot for the rocker arm assembly 115. For example, the actuator 127 may be mounted to an HLA 181. In some of these teachings, the HLA 181 and the rocker arm assembly 115 are held together by a removable clip (not shown). The clip may hold HLA 181 and rocker arm assembly 115 together during shipping and through installation of valve actuation module within an engine 100.

Figure 4:
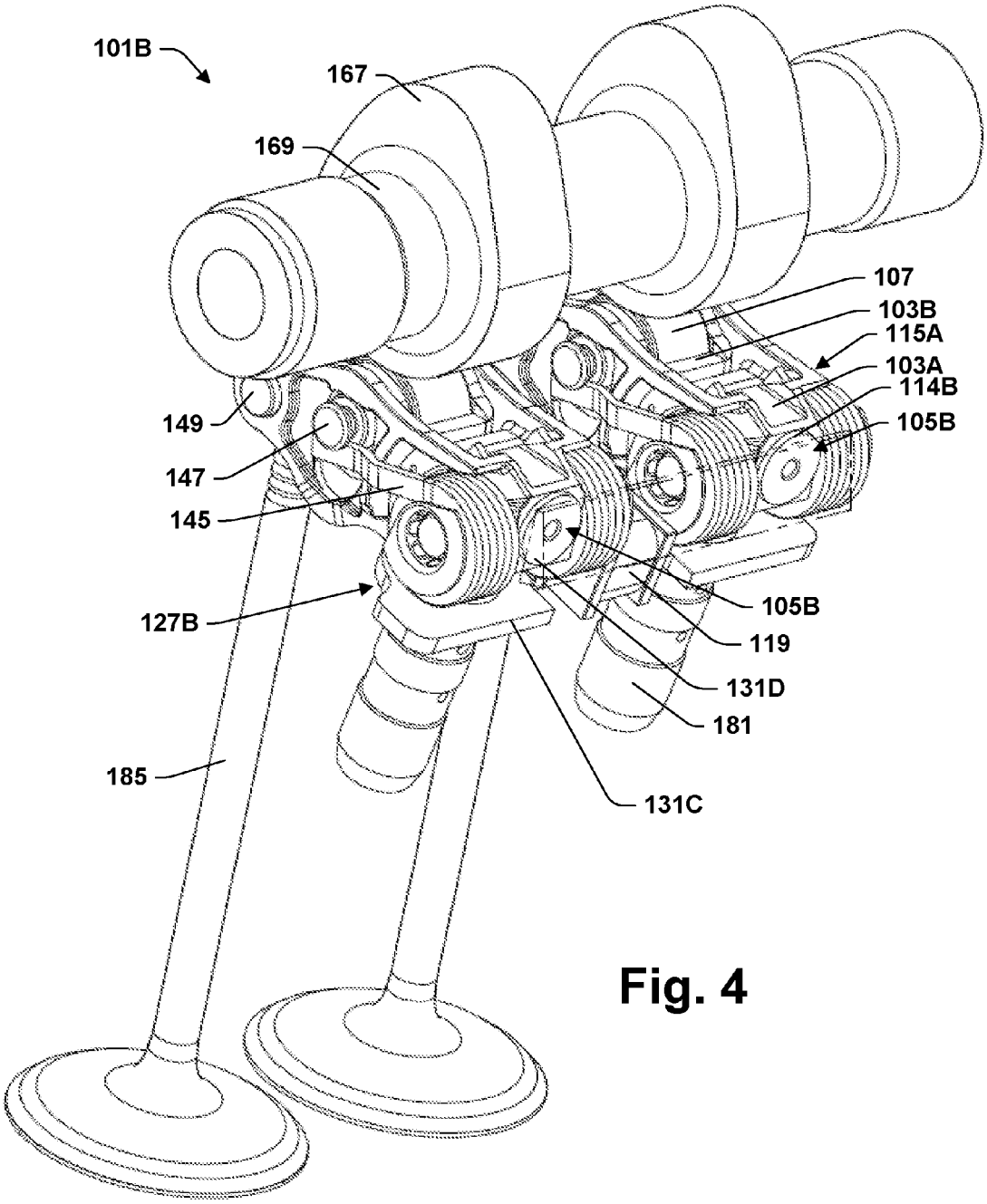
FIG. 4 provides a perspective view of a valvetrain according to some aspects of the present teachings with a pole piece shown in transparency.
Figure 5:
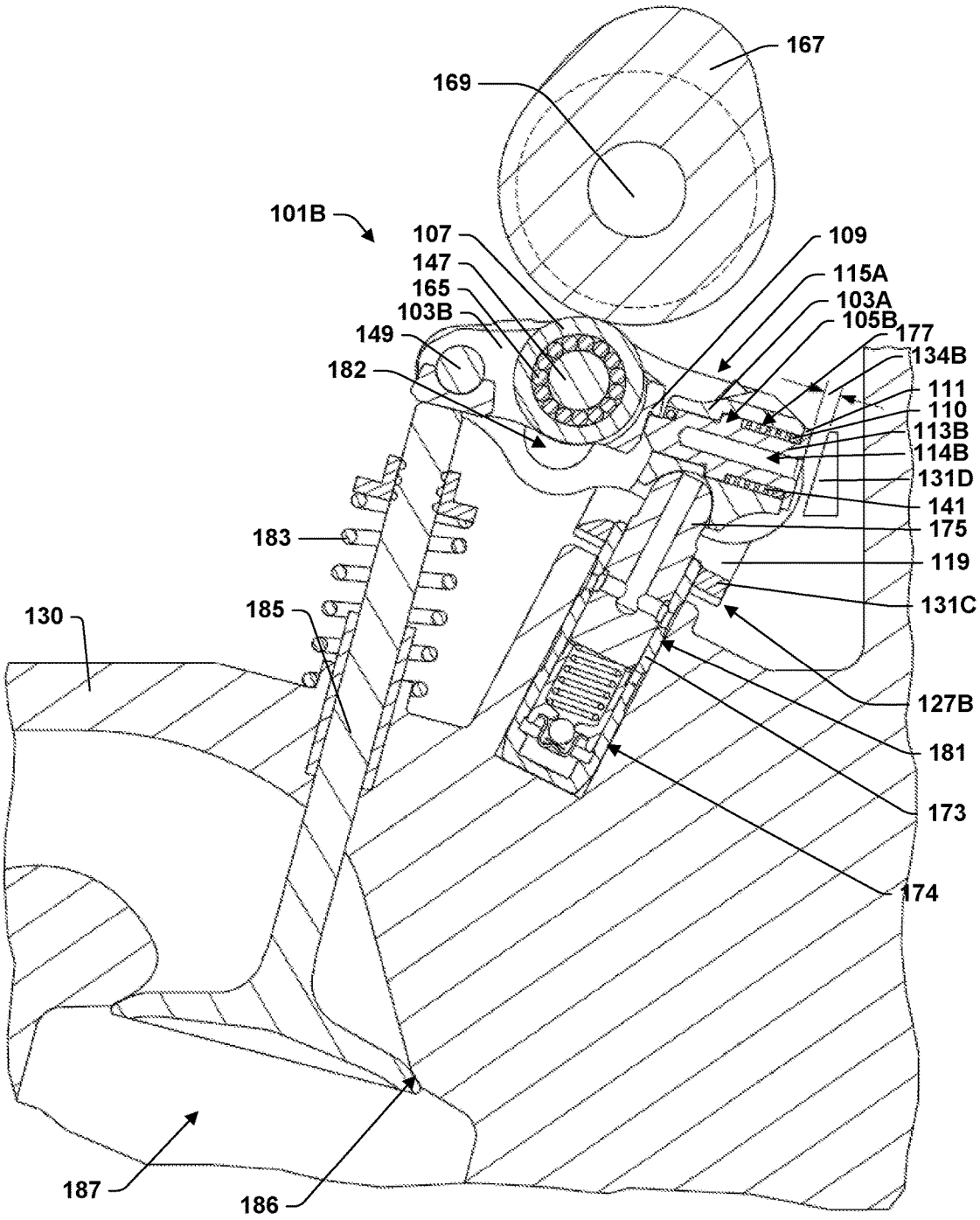
FIG. 5 is a partial cross-section of an internal combustion engine according to some aspects of the present teachings including a cross-section of the valvetrain of FIG. 4 through one of the rocker arm assemblies of that valvetrain.

FIG. 4 provides a perspective view of a portion of a valvetrain 101B according to some other aspects of the present teachings. Valvetrain 101B may be used in place of valvetrain 101A in engine 100A. FIG. 5 provides a cross-sectional view of what valvetrain 101B would look like in engine 100A. Valvetrain 101B may be the same as valvetrain 101A except that valvetrain 101B uses one or more latch assemblies 105B in place of one or more latch assemblies 105A. Latch assembly 105B includes actuator 127B and two latch pins 114B.

Figure 6:
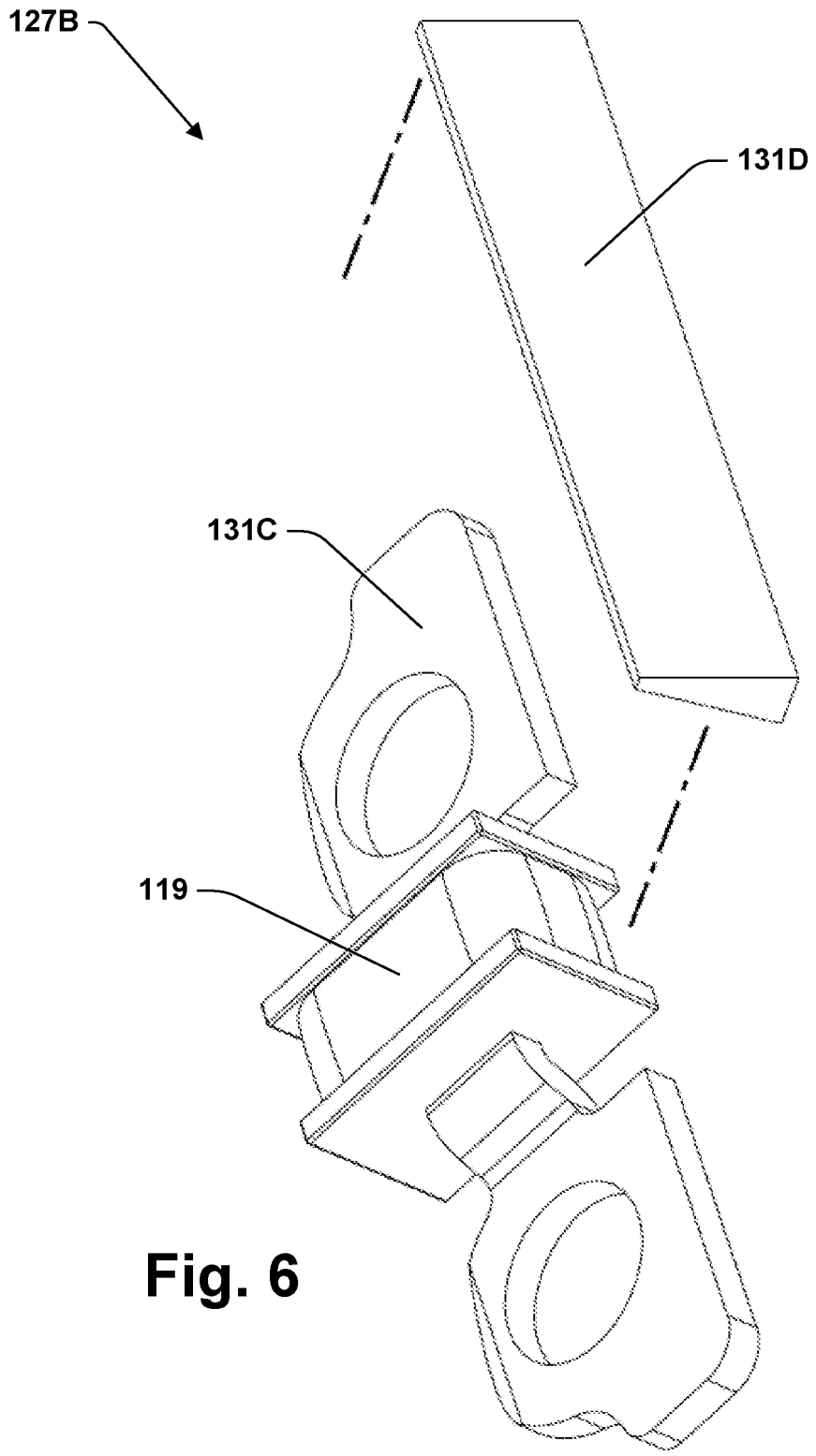
FIG. 6 is a perspective view of an actuator used in the valvetrain of FIG. 4.

FIG. 6 illustrates the parts of actuator 127B separately from other components of valvetrain 101B. Actuator 127B includes pole piece 131C, pole piece 131D, and electromagnet 119. Pole piece 131C may provide a core for electromagnet 119 and may be mounted to a pair of HLAs 181. Pole piece 131D may be mounted separately from pole piece 131C. As shown in FIGS. 4 and 5, pole piece 131D may be positioned between latch pins 114B and an outer portion of engine 101A, such as cylinder head 130. Pole piece 131D forms a low reluctance pathway for magnetic flux between two latch pins 114B. Pole piece 131D may be mounted to cylinder head 130.

Figure 7:
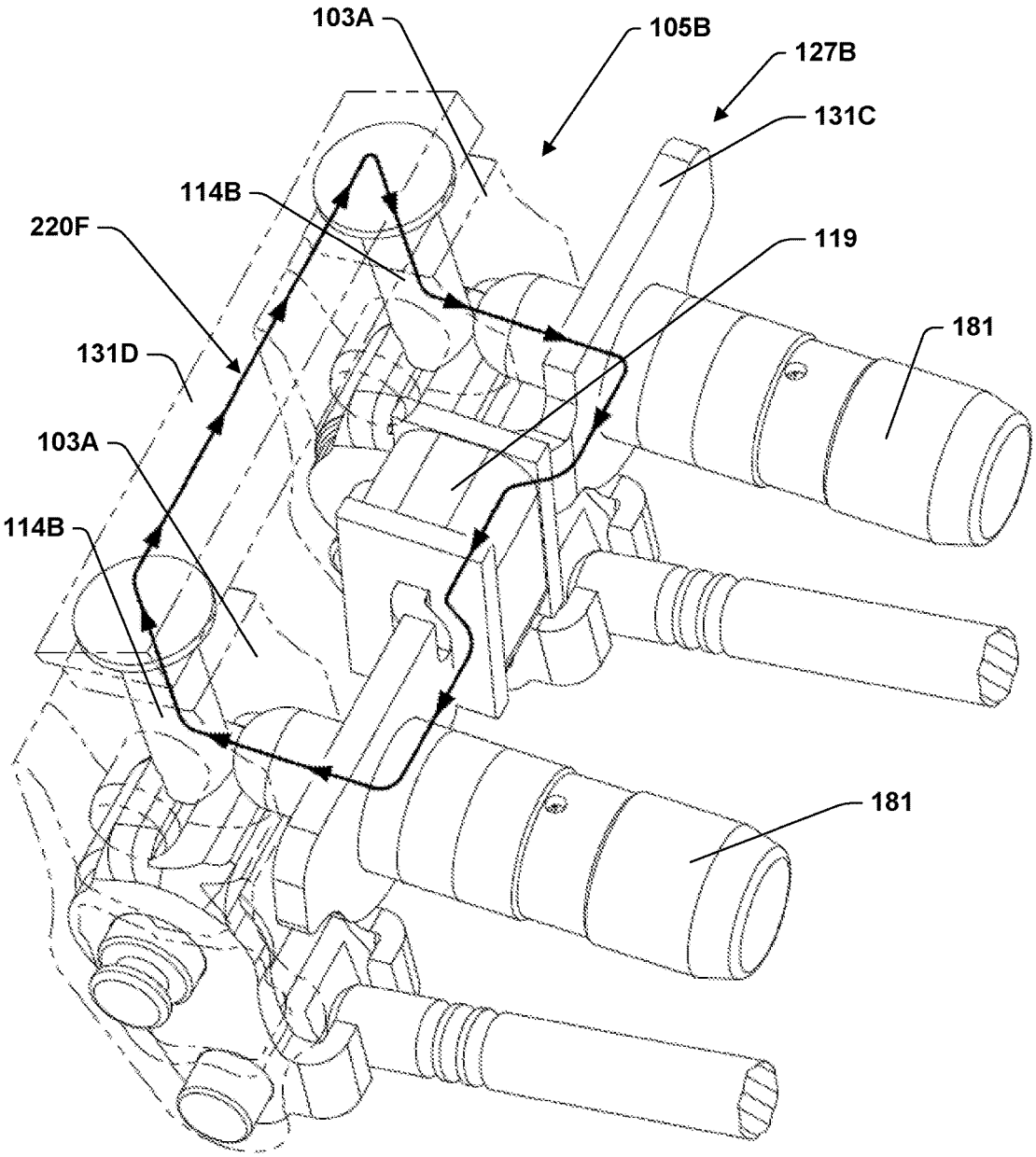
FIG. 7 is a perspective view of a portion of the engine of FIG. 5 showing some parts in transparency and illustrating a magnetic circuit according to some aspects of the present teachings.

Actuator 127B places electromagnet 119 between two adjacent rocker arm assemblies 115A. When electromagnet 119 is energized, it actuates the two latch pins 114B to their non-engaging position through magnetic flux that follows the magnetic circuit 220F illustrated in FIG. 7. Magnetic circuit 220F includes pole pieces 131C and 131D, two HLAs 181, two outer arms 103A, and two latch pins 114B. Magnetic flux from electromagnet 119 following magnetic circuit 220F proceeds from electromagnet 119 through pole piece 131C to one of the HLAs 181, up the HLA 181, through the associated rocker arm 103A, through the latch pin 114B mounted to that rocker arm 103A, across an air gap 134B to pole piece 131D, through pole piece 131D, across another air gap 134B to the other latch pin 114B, through the other rocker arm 103A, down through the other HLA 181, back into the pole piece 131C, and from there back to electromagnet 119. The magnetic flux polarizes low coercivity ferromagnetic materials throughout the circuit 220F and place magnetic force on latch pins 114B that causes them to actuate to the non-engaging position, narrowing the air gaps 134B in the process.

Referring to FIG. 5, latch pin 114B is held within a hydraulic chamber 177 that is formed in rocker arm 103A by a latch pin cage 110. In accordance with some of these teachings, latch pin cage 110 is paramagnetic, which may improve the operation of latch assembly 105B. In accordance with some of these teachings, latch pin 114B has an expanded end 111 that does not fit within the opening in rocker arm 103A out of which latch pin 114B extends. Expanded end 111 may have a larger cross-sectional area than the core 113B of latch pin 114B that travels within hydraulic chamber 177. End 111 may be relatively flat to fit closely against rocker arm 103A. The large cross-sectional area of end 111 facilitates its interaction with pole piece 131D. In accordance with some of these teachings, pole piece 131D is mounted to be facing end 111 when cam 167 is on base circle. The facing surfaces are parallel or nearly parallel. In some of these teachings, the facing surfaces are generally flat. In some of these teachings, one or both of the facing surfaces has one or more dimples. In some of these teachings, latch pin 114 contacts an actuator pole piece 131 when latch pin 114 is in the non-engaging position. Dimples may be operative to prevent end 111 and pole piece 131D from contacting over a large surface area and potentially sticking together. In some of these teachings the facing surfaces are parallel or nearly parallel to a direction of lash adjustment provided by lash adjuster 181. This geometry may facilitate maintaining operability of actuator 127B over a range of lash adjustment.

Figure 8:
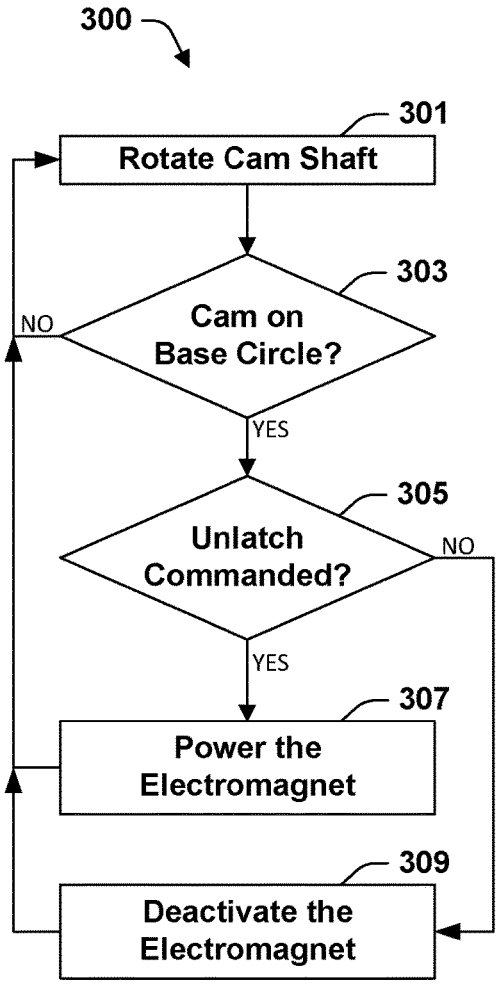
FIG. 8 is a flow chart of a method of operating an internal combustion engine according to some aspects of the present teachings.

FIG. 8 provides a flow chart of a method 300 by which engine 100A may be operated. Method 300 begins with act 301, rotating camshaft 169. Rotating camshaft 169 may be inherent in running engine 100A. Act 303 checks whether cam 167 is on base circle. Act 303 may be used to ensure that latch pin 114A is actuated only when cam 167 is on base circle. Rather than simply limit the start of actuation to times when cam 303 is on base circle, act 303 may more narrowly limit the range of cam phase angles at which latch pin actuation may be initiated to ensure that actuation is complete before cam 167 begins to rise off base circle. Act 305 determines whether an unlatch command, such as a command to deactivate valve 185, is currently in force. If yes, method 300 proceeds with act 307, powering electromagnet 119 to actuate latch pin 114 if latch pin 114 is not already in the non-engaging position. If no and latch pin 114 is not already in the engaging position, method 300 proceeds with act 309 to deactivate electromagnet 119 thereby allowing latch pin 114 to actuate to the engaging position under the influence of spring 141 or the like.

In some aspects of the present teachings, act 307 generates magnetic flux that enters a rocker arm 103 and actuates a latch pin 114 mounted on that rocker arm. Magnetic flux follows closed loops, so the flux that enters the rocker arm 103 also leaves the rocker arm 103 before returning to its source. In accordance with the present teachings, the flux that enters and leaves the rocker arm 103 is sufficient to result in latch pin 114 actuating. The source of magnetic flux may be relatively stationary with respect to combustion chamber 137. Rocker arm 103, on the other hand, is mobile with respect to combustion chamber 137. In some of these teachings, act 307 places a magnetic force directly on the latch pin 114. This force may initially actuate the latch pin 114 and subsequently maintain the position of latch pin 114 while the engine 100 continues to operate through act 301.

Act 307 may power electromagnet 119 with either an alternating current (AC) or a direct current (DC). In some of these teachings, act 307 powers electromagnet 119 with a DC current. In some of these teachings deactivating electromagnet 119 cuts power to electromagnet 119 entirely. But in some of these teachings, deactivating electromagnet 119 simply reduces the current or changes it in such a way that latch pin 114 ceases to be held in the non-engaging position.

Figure 9:
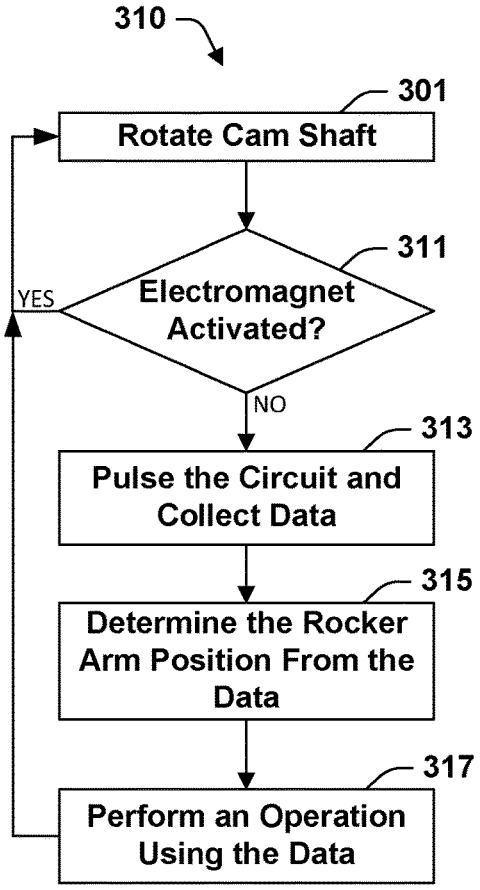
FIG. 9 is a flow chart of a diagnostic method according to some aspects of the present teachings.

FIG. 9 provides a flow chart of an example method 310 according to some aspects of the present teachings. Method 310 may be used with valvetrain 101A, valvetrain 101B, or any other valvetrain in which a latch pin 114A mounted to a rocker arm 103A is actuated using an electromagnet 119 operating through a magnetic circuit 220 having an air gap 134 that varies in width in relation to a motion of rocker arm 103A that actuates a poppet valve 185. Method 310 may be carried out simultaneously with method 300 and includes the act 301 which has camshaft 169 in a state of rotation. Act 311 is determining whether electromagnet 119 is currently actively engaged in actuated latch pin 114 or maintaining latch pin 114's position. The state of being active may be assumed if an unlatch state has been commanded. If not, method 310 proceeds with act 313, which is a data collection step.

Data collection may include measuring a current or voltage in an electrical circuit comprising electromagnet 119. A time variation in that current or voltage may be measured. In method 310, the electrical circuit is pulsed in connection with this data collection operation. That pulse may be insufficient in magnitude or duration to potentially actuate latch pin 114. The data may be obtained using any suitable measuring device. Examples of measuring devices that may be suitable include, without limitation, a shunt resistor and a Hall effect sensor.

Act 315 is determining the position of rocker arm 103A from the collected data. The data will depend on the inductance of the circuit, which will depend on the inductance of electromagnet 119, which will depend on the magnetic reluctance of a magnetic circuit 220, which will depend on the size of air gap 134, which will depend on the pivot angle of rocker arm 103A on the fulcrum provided by HLA 181, which determines the amount by which valve 185 has been lifted of its seat 186. Analyzing the data may include one or more of comparing the data to results obtained during calibration, comparing the data to model predictions, comparing the data to data obtained during a previous cam cycle, comparing the data to data obtained at other cam phases, and comparing similar data obtained from other rocker arms.

Act 317 is performing an operation that depends on the results of that analysis. In some of these teachings, that operation is an engine management operation. An engine management operation is one that affects a running state of engine 100. For example, the rocker arm position information may be use in a control algorithm. In some of these teachings, the information also relates to camshaft position. The camshaft position may be determined with greater accuracy or reliability by combining the data with similar data obtained from a second circuit containing a second electromagnet that is operable to actuate a latch pin on another rocker arm assembly of the engine 100. The camshaft position information may be used in the same way as information from a conventional camshaft position sensor. In particular, the information may be used to determine the timing of an ignition or a fueling event.

In some of these teachings, the operation of act 317 is a diagnostic. A diagnostic operation may include a reporting step. The report may be made selectively. The report may be sending a signal, such as illuminating a warning light. In some of these teachings, the diagnostic operation includes recording a diagnostic code in a data storage device. The diagnostic code may later be read by a technician.

In the example of method 310, the voltage pulse is limited by act 311 to periods in which electromagnet 119 is not being energized to hold or actuate latch pin 114. But the method does not need to be limited in that way. A pulse in voltage may be applied on top of a fixed voltage, whereby rocker arm position data may be obtained while electromagnet 119 is active to control a latch pin position. The size of air gap 134 is also affected by the position of latch pin 114. Therefore, method 310 may be extended to determine whether latch pin 114 is in the extended or retracted position.

In some of these teachings, information obtained from the circuit comprising electromagnet 119 is used to distinguish among three states. In the first state, latch pin 114 is in the non-engaging configuration. In the second state, latch pin 114 is in the engaging configuration and cam 167 is on base circle. In the third state, latch pin 114 is in the engaging configuration and cam 167 is off base circle.

Method 310 collects data in conjunction with a voltage pulse. In another method provided by the present disclosure, the circuit including electromagnet 119 is driven continuously over extended periods in a way that enables the data collection but does not affect the position of latch pin 114. The periods may be in excess of the time taken for camshaft 169 to complete a rotation. The drive current may be limited to prevent any effect on latch pin 114. For example, the circuit may be driven with a low voltage to facilitate data collection without actuating latch pin 114. In some of these teachings, an AC current is provided for data collection while a DC current is provided to influence the position of latch pin 114.

In another alternative provided by the present disclosure, the electrical circuit including electromagnet 119 is monitored passively. If there is magnetic flux in a circuit 220 comprising electromagnet 119, any expansion or contraction of air gap 134 will produce a change in that flux and induce a current in electromagnet 119. That induced current may be detected and analyzed to determine the change in air gap 134. In some of these teaching, a permanent magnet is configured to continuously maintain a magnetic flux in circuit 220. That flux may be insufficient to hold latch pin 114 in any particular position.

In some of these teachings, method 310 or one of the variations thereof described above is used to detect a critical shift in rocker arm assembly 115A. A critical shift is the case where latch pin 114 comes out of the engaging position while cam 167 is lifting rocker arm 103B. If this happened, rocker arm 103A will be driven by valve spring 183 to rapidly pivot from a lifted position like the one shown in FIG. 1C to its base circle position shown in FIG. 1D. In some of these teachings, a critical shift is detected from the speed with which inductance or a related property varies. In some of these teachings, a critical shift is detected from an induced current in the circuit. In some of these teachings, a critical shift is detected from data indicating a premature return to base circle.

Figure 10A:
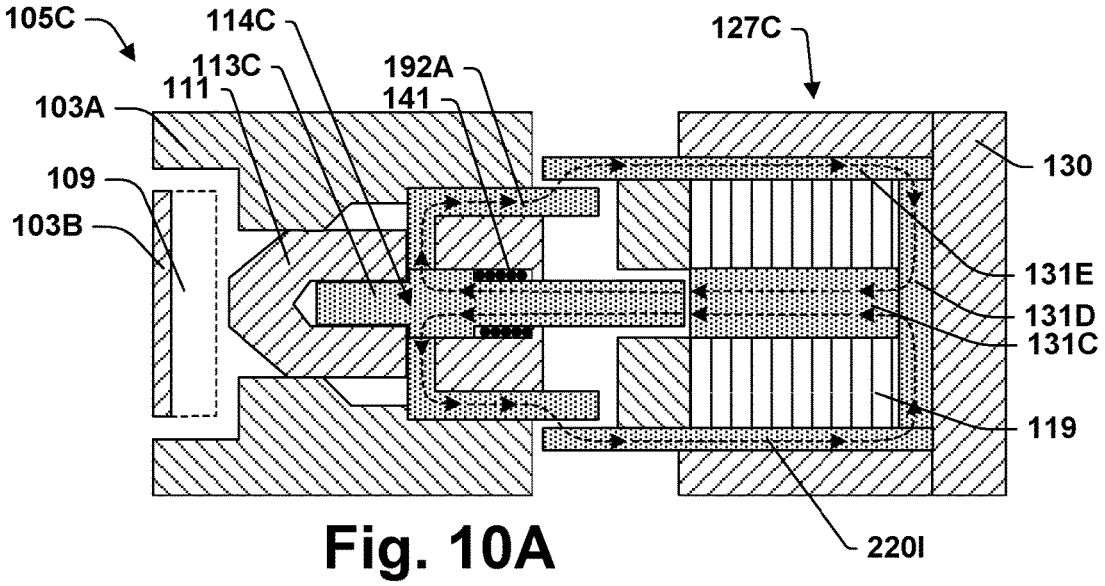
FIG. 10A illustrates a latch assembly according to some aspects of the present teachings with the latch pin in a non-engaging position.
Figure 10B:
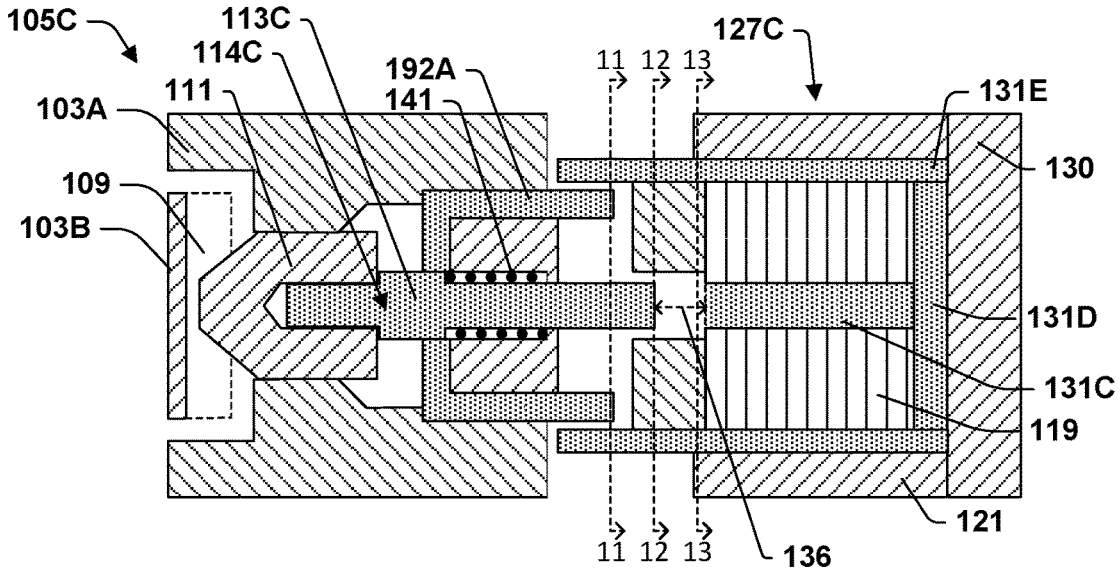
FIG. 10B illustrates the latch assembly of FIG. 10A with the latch pin in an engaging position.

FIGS. 10A and 10B provide cross-sectional views illustrating a latch assembly 105C according to some other aspects of the present teachings. Latch assembly 105C may be used in place of latch assembly 105A in engine 100A. Latch assembly 105C include latch pin 114C mounted on rocker arm 103A and actuator 127C, which is mounted to cylinder head 130. Latch pin 114C includes a low coercivity ferromagnetic core 113C to which a latch pin head 111 is journaled. Actuator 127C includes electromagnet 119 and pole pieces 131C, 131D, and 131E.

FIG. 10A illustrates the non-engaging configuration and FIG. 10B illustrates the engaging configuration. The engaging configuration is maintained by spring 141, which opens air gap 136. The non-engaging configuration is obtained by energizing electromagnet 119, which generates magnetic force on latch pin 114C sufficient to overcome the force of spring 141 and close air gap 136 through magnetic flux travelling circuit 220l. Magnetic circuit 220l includes pole pieces 131C, 131D, and 131E of actuator 127C. Magnetic circuit 220l also include core 113C of latch pin 114C and a pole piece 192A fixed on rocker arm 103A. A pole piece may be any part formed of low coercivity ferromagnetic material and located in a position where it is operative to complete a magnetic circuit. Because pole piece 192A is fixedly attached to rocker arm 103A, it may be considered part of rocker arm 103A in the terminology of this specification and the claims that follow.

Figure 11A:
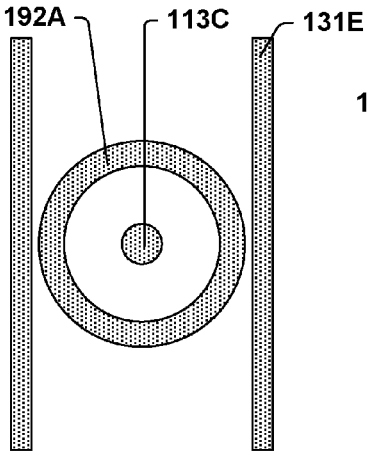
FIG. 11A illustrates a cross-section along the line 11-11 of FIG. 10B.
Figure 12A:
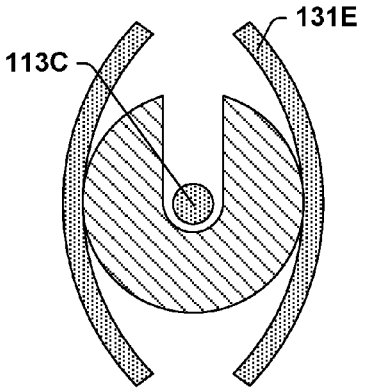
FIG. 12A illustrates a cross-section along the line 12-12 of FIG. 10B.
Figure 13A:
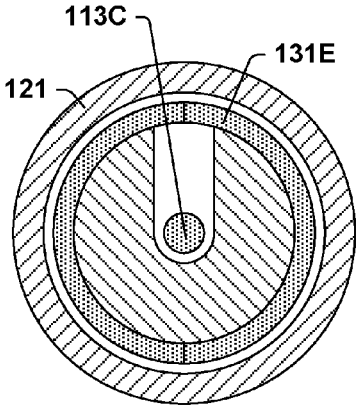
FIG. 13A illustrates a cross-section along the line 13-13 of FIG. 10B.
Figure 11B:
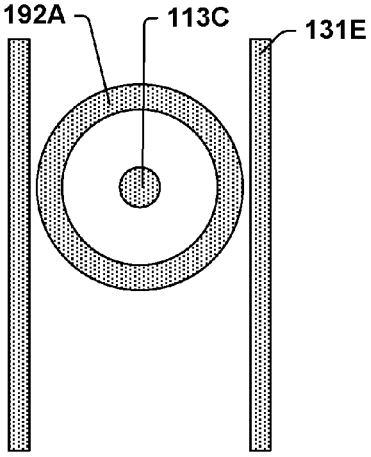
FIG. 11B illustrates the cross-section along the line 11-11 of FIG. 10B as it would appear after a cam has raised the rocker arm.
Figure 12B:
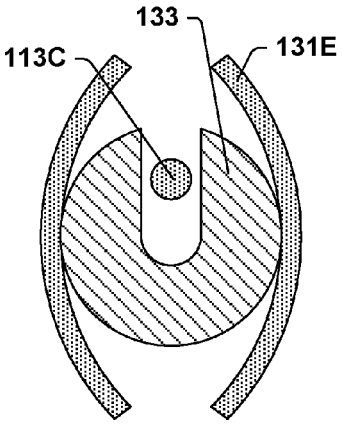
FIG. 12B illustrates the cross-section along the line 12-12 of FIG. 10B as it would appear after a cam has raised the rocker arm.
Figure 13B:
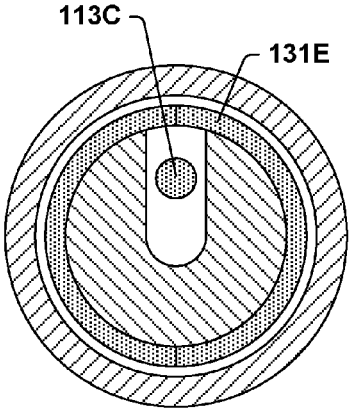
FIG. 13B illustrates the cross-section along the line 13-13 of FIG. 10B as it would appear after a cam has raised the rocker arm.

Pole piece 192A and pole piece 131C form a sliding magnetic joint that keeps magnetic circuit 220l closed even as rocker arm 103A pivots through a range of motion on HLA 181. The shapes of these pieces are illustrated by FIGS. 11, 12 and 13, which show cross-sections through actuator 127C taken along lines 11-11, 12-12, and 13-13 of FIG. 10B. FIGS. 11A, 12A, 13A show the spatial relationships when rocker arm 103A is not being lifted by any cam and FIGS. 11B, 12B, 13B show the relationships when rocker arm 103A is lifted. As shown by these figures, pole piece 192A and latch pin core 113C may have cylindrical profiles. Pole pieces 131E may be provided as two pieces curved to form half cylinders where they lie adjacent electromagnet 192 progressively flattening as they extend outward from electromagnet 119 and eventually forming planar shapes as shown in FIGS. 11A and 11B in the region where they are adjacent pole piece 192A. In this region, pole pieces 131E have surfaces extending along a direction in which pole piece 192A moves relative to pole pieces 131E as a result of rocker arm 103A pivoting. That movement is essentially vertical.

Maintaining the operability of magnetic circuit 220l through a range of rocker arm 103's motion has several potential applications. In some of these teachings, rocker arm 103A is modified to include cam followers and valvetrain 101A is modified with additional cams to provide an alternate valve lift profile, such as a low lift profile, for valve 185 when latch pin 103B is in the non-engaging position.

Figure 14A:
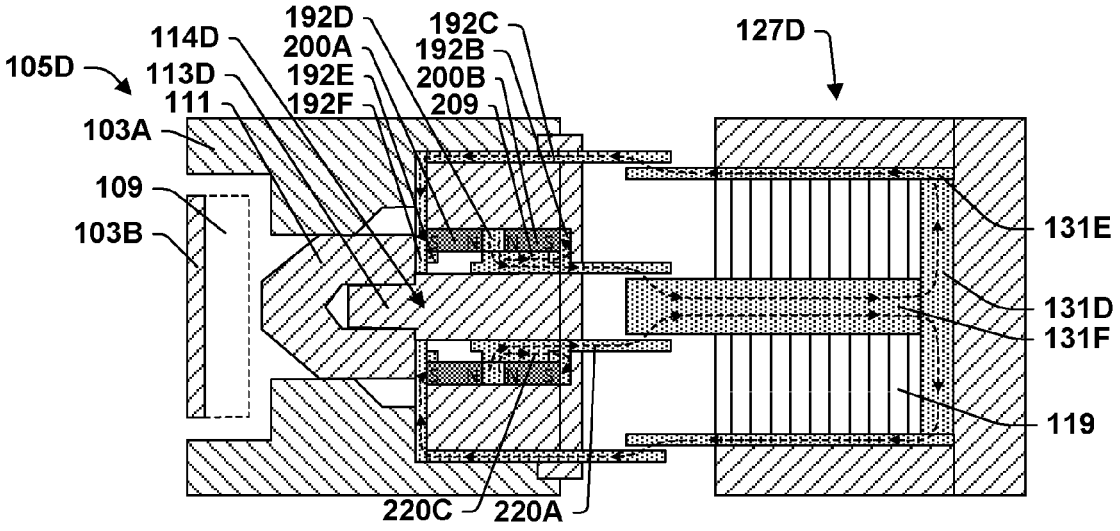
FIG. 14A illustrates a latch assembly according to some aspects of the present teachings with the latch pin in a non-engaging position.
Figure 14B:
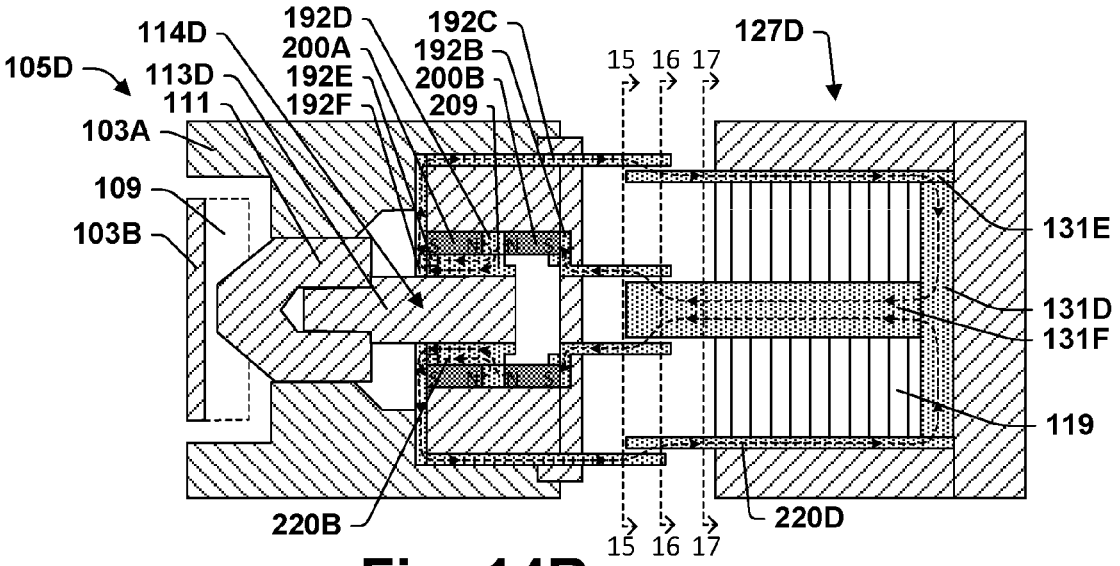
FIG. 14B illustrates the latch assembly of FIG. 14A with the latch pin in an engaging position.

FIGS. 14A and 14B provide cross-sectional views illustrating a latch assembly 105D according to some other aspects of the present teachings. Latch assembly 105D is another alternative to latch assembly 105A that may be used in engine 100A. Latch assembly 105D includes latch pin 114D, which may be mounted on rocker arm 103A, and actuator 127D, which may be mounted to cylinder head 130. Latch pin 114D includes a low coercivity ferromagnetic yoke 209 fixed around a paramagnetic core 113C to which a latch pin head 111 is journaled. Actuator 127D includes electromagnet 119 and pole pieces 131D, 131E, and 131F. FIG. 14A illustrates latch pin 114D in a non-engaging position and FIG. 10B illustrates latch pin 114D in an engaging position.

Latch assembly 105D further includes parts that are fixedly mounted to rocker arm 103A. These include permanent magnet 200A, permanent magnet 200B, and pole pieces 192C, 192D, 192E, and 192F. Permanent magnets 200A and 200B may be cylindrical. They are arranged with confronting polarity and separated by pole piece 192D, which is also cylindrical. In accordance with some aspects of the present teachings, latch assembly 105D provides latch pin 114D with stability in either the engaging or the non-engaging position. The stability referred to here is a positional stability. A stable position may correspond to a local minimum in a potential energy that is variable over a bounded range. A position may be stabilized by restorative forces that are generated without external power. Restorative forces will tend to return latch pin 114D to one of its stable positions if latch pin 114D is displaced from that position by a small perturbation. Restorative forces may be provided by springs, permanent magnets, or a combination thereof. For example, latch assembly 105A uses a spring 141 to stably maintain the engaging configuration. In latch assembly 105D, restorative forces are provided by permanent magnets 200A and 200B.

Permanent magnet 200A stabilizes the position of latch pin 114D in both the engaging and the non-engaging configurations. When latch pin 114D is in the non-engaging configuration, absent magnetic fields from electromagnet 119 or any external source, magnetic circuit 220A provides the path for an operative portion of magnetic flux from permanent magnet 200A. The path for an operative portion of magnetic flux from a magnet is a path taken by the majority of flux from that magnet. Magnetic circuit 220A passes from the north pole of permanent magnet 200A, through pole piece 192D, through yoke 209 of latch pin 114D, through pole pieces 192C, across to actuator 127D and through pole pieces 131F, 131D, and 131E of actuator 127D, back to rocker arm 103A through pole pieces 192C, then through pole piece 192F to the south pole of permanent magnet 200A.

Permanent magnet 200B also stabilizes the position of latch pin 114D in both the engaging and the non-engaging configurations. When latch pin 114D is in the non-engaging configuration, magnetic circuit 220C provides the path for an operative portion of magnetic flux from permanent magnet 200B. Magnetic circuit 220C passes from the north pole of permanent magnet 200B, through pole piece 192D, through yoke 209 of latch pin 114D, through pole piece 192B, to the south pole of permanent magnet 200B. Magnetic circuit 220C is shorter than magnetic circuit 220A and does not pass through actuator 127C.

When latch pin 114D is in the engaging position, absent magnetic fields from electromagnet 119 or any external source, magnetic circuit 220B provides the path for an operative portion of magnetic flux from permanent magnet 200A. Magnetic circuit 220B passes from the north pole of permanent magnet 200A, through pole piece 192D, through yoke 209 of latch pin 114D, through pole piece 192F and 192E, to the south pole of permanent magnet 200A. Magnetic circuit 220B is shorter than magnetic circuit 220D and does not pass through actuator 127C.

In the engaging position, magnetic circuit 220D provides the path for an operative portion of magnetic flux from permanent magnet 200B. Magnetic circuit 220D passes from the north pole of permanent magnet 200B, through pole piece 192D, through yoke 209 on latch pin 114D, through pole pieces 192F and 192C, through pole pieces 131E, 131D, and 131F of actuator 127C, through pole piece 192B to the south pole of permanent magnet 200A.

In actuator 127D, electromagnet 119 may be operative both to actuate latch pin 114D from the engaging position to the non-engaging position and from the non-engaging position to the engaging position. To enable this operability, circuitry (not shown) such as an H-bridge is provided that can be used to connect electromagnet 119 to a voltage source with either a forward polarity or a reverse polarity. If the current is started in a forward direction while latch pin 114D is in the non-engaging position, the resulting magnetic field may reverse magnetic polarity in low coercivity ferromagnetic materials within magnetic circuit 220A. This greatly increases the reluctance of magnetic circuit 220A for flux from permanent magnet 200A. Magnetic circuit 220C is likewise affected. Magnetic flux from permanent magnets 200A and 200B may be shifted away from magnetic circuits 220A and 220C and toward magnetic circuits 220B and 220D. The resulting magnetic forces on latch pin 114D may drive it toward the engaging position. Latch pin 114D may reach the engaging position and tend to remain there even after electromagnet 119 has been disconnected from its power source. If the current is subsequently started in a reverse direction while latch pin 114D is in the engaging positon, the entire process may be reversed and latch pin 114D returned to the non-engaging position.

Yoke 209 of latch pin 114D may have a stepped edge. Pole pieces 192E may be shaped to mate with that edge. During actuation, magnetic flux may cross an air gap between yoke 209 and pole pieces 192E. The stepped edge may increase the magnetic forces through which latch pin 114D is actuated between its engaging and non-engaging positions.

Figure 15A:
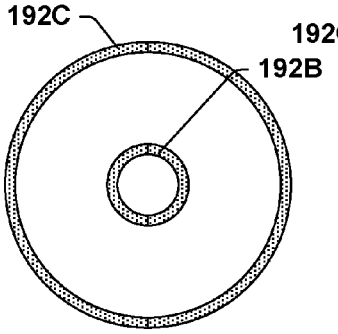
FIG. 15A illustrates a cross-section along the line 15-15 of FIG. 14B.
Figure 16A:
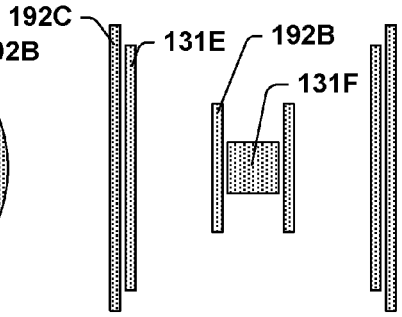
FIG. 16A illustrates a cross-section along the line 16-16 of FIG. 14B.
Figure 17A:
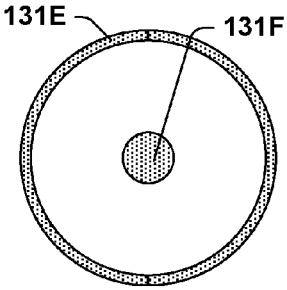
FIG. 17A illustrates a cross-section along the line 17-17 of FIG. 14B.
Figure 15B:
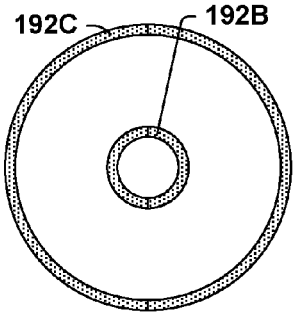
FIG. 15B illustrates the cross-section along the line 15-15 of FIG. 14B as it would appear after a cam has raised the rocker arm.
Figure 16B:
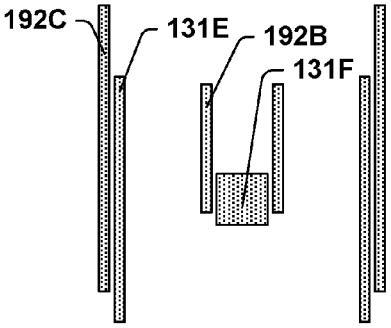
FIG. 16B illustrates the cross-section along the line 16-16 of FIG. 14B as it would appear after a cam has raised the rocker arm.
Figure 17B:
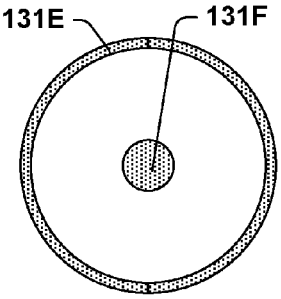
FIG. 17B illustrates the cross-section along the line 17-17 of FIG. 14B as it would appear after a cam has raised the rocker arm.

Sliding magnetic joints may be used to keep magnetic circuits 220A and 220D operative to help maintain the position stability of latch pin 114D throughout the range of motion of rocker arm 103A. These sliding magnetic joints are illustrated by FIGS. 15A, 16A, and 17A, which illustrate cross-sections through actuator 127D taken along the lines 15-15, 16-16, and 17-17 respectively of FIG. 14B. FIGS. 15B, 16B, and 17B illustrate corresponding cross-sections, but with changes resulting for rocker arm 103A being lifted by a cam.

As illustrated by these figures, a first sliding magnetic joints is formed between pole pieces 192C and 131E and a second sliding magnetic joint is formed between pole pieces 192B and 131F. At any given time, one joint carries flux from rocker arm 103A to actuator 127D and the other returns flux from actuator 127D to rocker arm 103A. All these pole pieces form nearly planar surfaces in areas where they come adjacent each other. Pole piece 192C and 192B flatten as they extend toward actuator 127D. Likewise, pole pieces 131E and 131F flatten toward planar and square shapes as they extend toward rocker arm 103A. Providing each pole piece with a surface extending in the direction of motion allows the two surface to remain proximate and provide a large area for magnetic flux transfer throughout the range of motion.

As the used in the present disclosure, a sliding joint in a magnetic circuit may refer to two parts in a magnetic circuit that are separated by an air gap and are configured to undergo relative motion without the air gap varying much in size. A variation that remains less than 50% may be considered not much for purposes of this definition. In some of these teachings, one of the parts forming the sliding joint has a surface adjacent the air gap that is substantially parallel to a direction along which one of the parts is free to move relative to the other.

Figure 18:
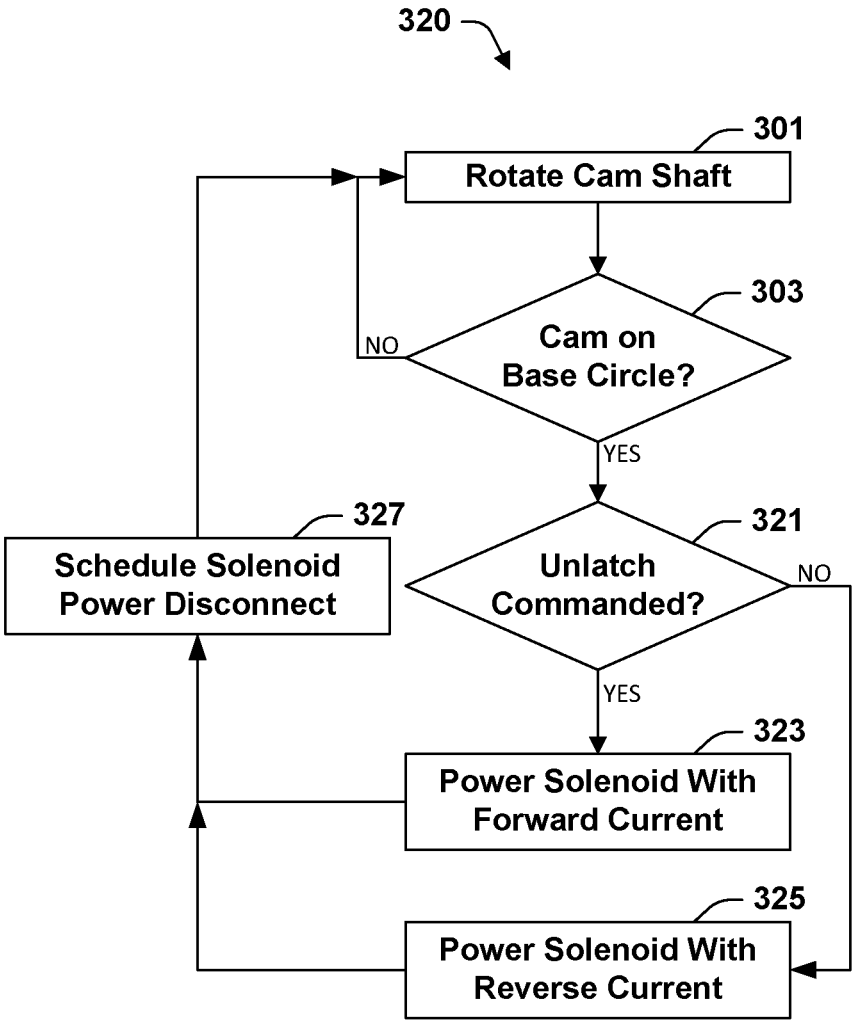
FIG. 18 is a flow chart of a method of operating an internal combustion engine in accordance with some aspects of the present disclosure.

FIG. 18 is flow chart of a method 320 providing an example of how an engine 100 having a bi-stable latch assembly 105 may be operated in accordance with some aspects of the present teaching. Method 320 may include acts 301 and 303 of method 300. Method 320 includes a decision step 321 that may be similar to the decision step 305 of method 300. The decision step 321 determines whether an unlatched state of latch pin 114 has been commanded. If it has, action may be predicated on whether latch pin 114 is believed to be in the latched state. That belief may be based on a previous execution of a latching operation or on diagnostic feedback relating to the position of latch pin 114. If that predicate is not satisfied, method 320 may continue with action 301. In some of these teachings, however, that predicate is not implemented. Actuating a bi-stable latch pin 114 may require little power and a redundant attempt to actuate latch pin 114 to a position it is already in may be harmless.

If an unlatch state is commanded, method 320 may continue with act 323, powering electromagnet 119 with a current in a first direction. Energizing electromagnet 119 with a current in a first direction may include connecting a circuit (not shown) comprising electromagnet 119 to a DC voltage source (not shown). If an unlatched state is not commanded, that may be equivalent to a command for a latched state and method 320 may continue with act 325, powering electromagnet 119 with a current in a reverse of the first direction. Energizing electromagnet 119 with a current in a reverse direction of the first direction may include coupling electromagnet 119 to the same voltage source, but with a reverse polarity. The reversal of polarity may be accomplished with an H-bridge.

Following act 323 or 325, method 320 optionally continues with act 327, scheduling an interruption of the current being supplied to electromagnet 119. Interrupting the power supply after it is no longer required saves energy. In some of these teachings, the time for interrupting the power is predetermined. Only a brief time is required for latch pin actuation. An entire actuation operation may be completed while cam 167 is on base circle. In a bi-stable latch, the power may be interrupted before actuation is entirely complete. The latch pin stabilizing forces may complete the motion. In some of these teachings, the time for interrupting the current is determined by monitoring the current in a circuit comprising electromagnet 119. Under a constant voltage, the current in a circuit comprising electromagnet 119 will vary as latch pin 114 actuates. The current will become steady after latch pin actuation has completed. After power has been disconnected, engine 100 continues to operate through act 301 and the position of latch pin 114 is maintained by springs, permanent magnets, or a combination thereof. In some of these teaching, an operative portion of flux from a permanent magnet 200 that maintains latch pin 114 mounted on rocker arm 103 in a stable position follows a flux path that includes an actuator 127 that is not mounted on the rocker arm 103.

Figure 19A:
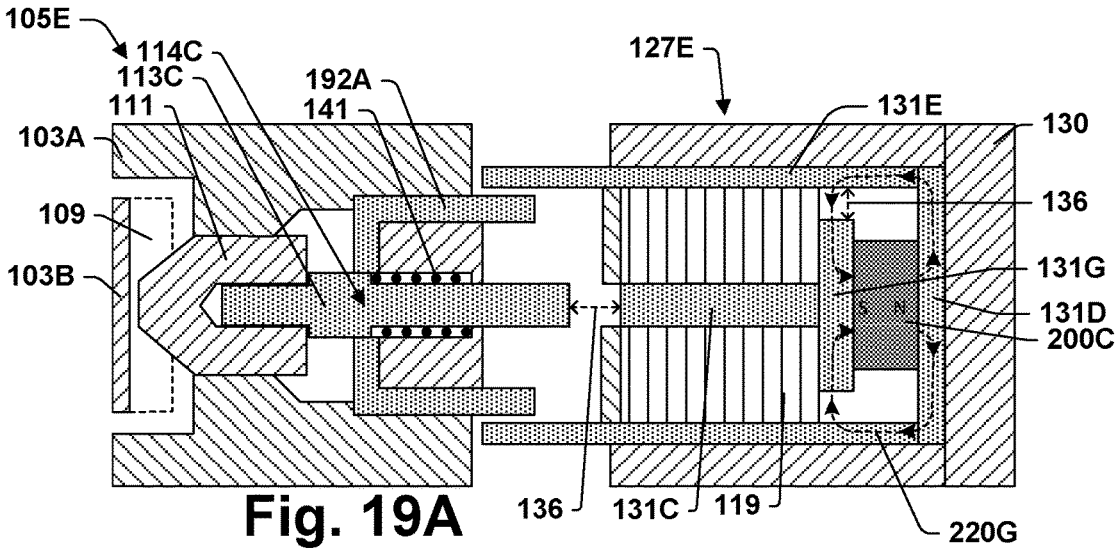
FIG. 19A illustrates a latch assembly according to some aspects of the present teachings with the latch pin in an engaging position.
Figure 19B:
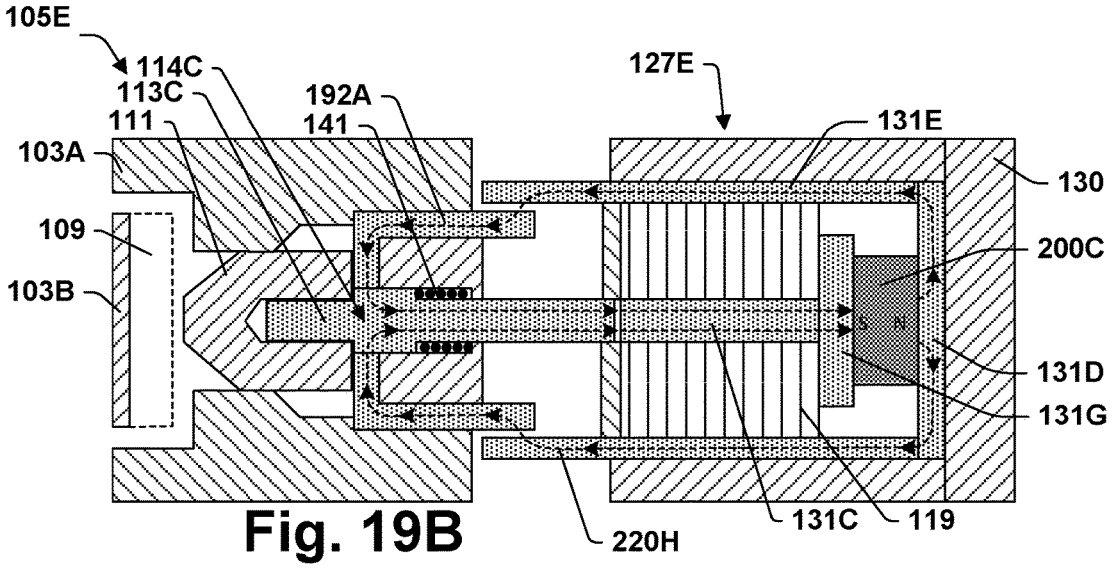
FIG. 19B illustrates the latch assembly of FIG. 19A with the latch pin in a non-engaging position.

FIGS. 19A and 19B provide cross-sectional views illustrating a latch assembly 105E according to some other aspects of the present teachings. Latch assembly 105E is another alternative to latch assembly 105A that may be used in engine 100A. Latch assembly 105D includes actuator 127E mounted off rocker arm 103A and latch pin 114C, which is mounted to rocker arm 103A. Latch assembly 105D is operative to stabilize the position of latch pin 114C in both its engaging and non-engaging positions. Actuator 127E includes electromagnet 119, pole pieces 131C, 131G, and 131E, and a permanent magnet 200C.

In latch assembly 105E, when latch pin 114C is in the non-engaging position, latch pin 114C is held there by magnetic flux that is generated by permanent magnet 200C and follows a magnetic circuit 220G. Magnetic circuit 220G provides the path for an operative portion of permanent magnet 200C's magnetic flux. Magnetic circuit 220G passes from the north pole of magnet 200C through pole pieces 131D and 131E of actuator 127E, through pole piece 192A, through latch pin 114C, through pole pieces 131C and 131G of actuator 127D to the south pole of magnet 200C. Magnetic circuit 220G may be maintained throughout the range of motion of outer arm 103A by sliding magnetic joints, although that is not necessary if outer arm 103A remains stationary while latch pin 114C is in the non-engaging position.

If electromagnet 119 of actuator 127E is energized with current in a suitable first direction while latch pin 114C is in the non-engaging position, some magnetic polarities in magnetic circuit 220G may be reversed. Flux from permanent magnet 200C may be redirected to a magnetic circuit 220H, which is illustrated in FIG. 19A. Magnetic circuit 220H passes from the north pole of magnet 200C through pole pieces 131D, 131E and 131G of actuator 127D, to the south pole of magnet 200C. Magnetic circuit 220H does not pass through latch pin 114C. Energizing electromagnet 119 with current in the first direction disrupts the magnetic attraction between latch pin 114C and pole piece 131C allowing spring 141 to drive latch pin 114C to the engaging position and hold it there.

When latch pin 114C moves to the engaging configuration, it introduces an air gap 136 into magnetic circuit 220G. Air gap 136 greatly increases the magnetic reluctance of magnetic circuit 220G. Therefore, there may be little or no tendency for magnetic flux from permanent magnet 200C to shift back to magnetic circuit 220G until electromagnet 119 is energized with current in a reverse of the first direction. When electromagnet 119 of actuator 127D is so energized, polarities in magnetic circuit 220G may be re-established in a direction that attracts flux from permanent magnet 200C. Permanent magnet 200C and electromagnet 119 may then cooperate to magnetically actuate latch pin 114C back to the non-engaging configuration where latch pin 114C may be stably maintained by permanent magnet 200C alone.

Actuation in latch assemblies 105D and 105E occurs through a flux shifting mechanism. A flux-shifting mechanism involves redirecting the flux from a permanent magnetic from a first magnetic circuit to a second distinct magnetic circuit. In some of these teachings, the first and second circuits share a structural element formed of a low coercivity ferromagnetic material. A first magnetic polarity in that structural element favors the magnetic flux traveling the first circuit and a second polarity favors the magnetic flux traveling the second circuit. The availability of the second magnetic circuit may reduce the energy required to actuate a latch pin away from a position that is held by a permanent magnet with its flux following the first magnetic circuit.

Figure 20:
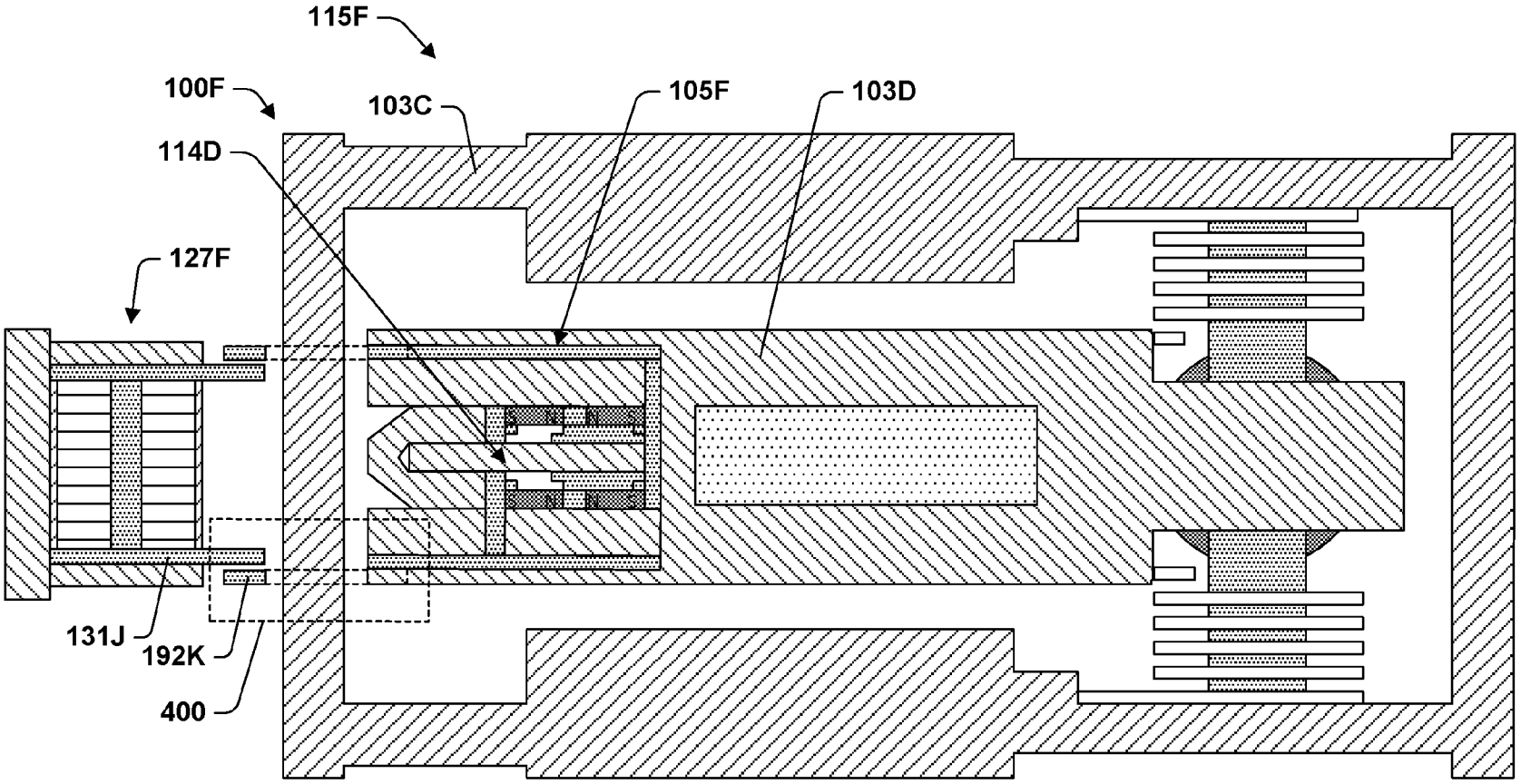
FIG. 20 is a top partial cutaway view of an internal combustion engine according to some other aspects of the present teachings FIG. 21A provides a side view illustrating the relative positioning of the parts shown in region 400 of FIG. 20.

FIG. 20 illustrates and engine 100F in accordance with some further aspects of the present teachings. Engine 100F include a latch assembly 105F and a switching rocker arm assembly 115F. Switching rocker arm assembly 115F include an inner arm 103D and an outer arm 103C. Latch assembly 105F includes actuator 127F mounted off rocker arm assembly 115F and latch pin 114D mounted to inner arm 103D. Rocker arm 103D includes a pole piece 192K. Actuator 127F includes a pole piece 131J. These pole piece remain adjacent and close magnetic circuits formed by latch assembly 105F throughout the ranges of motion of rocker arms 103C and 103D.

Figure 21C:
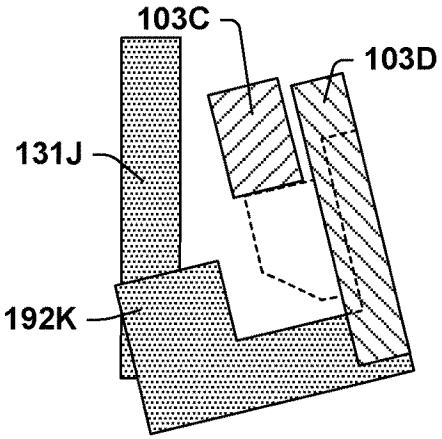
FIG. 21C provides a side view illustrating the relative positioning of the parts shown in FIG. 20 after the cams rise off base circle with the latch pin in an engaging position.
Figure 21B:
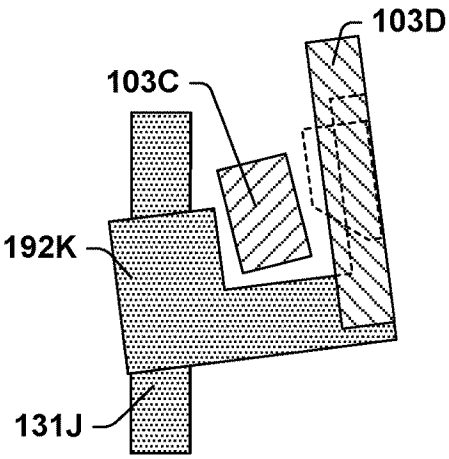
FIG. 21B provides a side view illustrating the relative positioning of the parts shown in FIG. 20 after the cams rise off base circle with the latch pin in a non-engaging position.
Figure 21A:
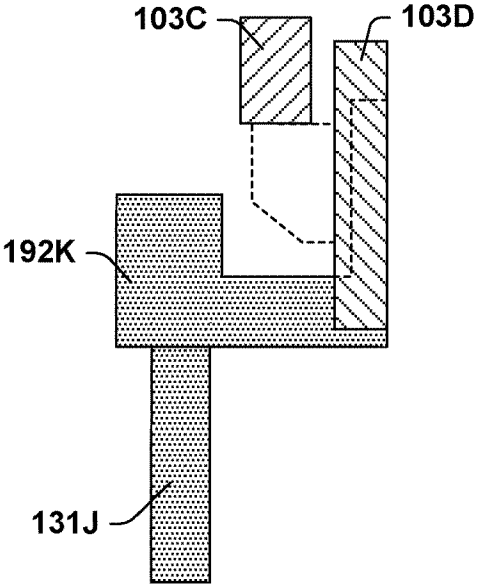

FIGS. 21A-21C illustrate the relative positioning of pole pieces 192K and 131J for various states of rocker arm assembly 115F. FIG. 21A shows the relative positioning when neither rocker arm 103C or 103D is lifted by a cam. FIG. 21B shows the relative positioning when both rocker arm 103C or 103D are in positons of maximum lift with latch pin 114D in a non-engaging configuration. FIG. 21C shows the relative positioning when both rocker arm 103C or 103D are in positons of maximum lift with latch pin 114D in an engaging configuration. As can be seen from these illustrations, pole pieces 192K and 131J form a sliding magnetic joint and are able to keep magnetic circuits that include rocker arm 103D, latch pin 114D, and actuator 127F closed throughout the ranges of motion of rocker arms 103C and 103D, in both engaging and non-engaging configurations, and without interfering with the rocker arm motions. Pole pieces 192K and 131J may remain continuously proximate over a large surface area. In some of these teachings, this same effect is achieved using pole pieces mounted to or incorporated within outer arm 103C. That alternative structure may reduce the overall size of latch assembly 105F.

The rocker arms 103 of the examples herein are all rocker arms that have been put into production for use with a hydraulically actuated latch. For example, with reference to FIG. 1A, latch pin 114A is installed within a hydraulic chamber 177 of rocker arm 103A. The surface 178 through which rocker arm 103A contacts hydraulic lash adjuster 181 is shaped to form a hydraulic seal with lash adjuster 181. In some of these teachings, rocker arm assembly 115 includes a hydraulic lash adjuster 181 that was put into production for use with a hydraulically latching rocker arm. Hydraulic lash adjuster 181 may include a port 179 configured to channel hydraulic fluid from cylinder head 130 to rocker arm 103A. For hydraulic operation, a port for hydraulic fluid is formed by drilling a hole in rocker arm 103A from surface 178 into hydraulic chamber 177. That is a post-production step that need not be carried out when rocker arm 103A is used for electromagnetic latching as described herein.

The components and features of the present disclosure have been shown and/or described in terms of certain aspects and examples. While a particular component or feature, or a broad or narrow formulation of that component or feature, may have been described in relation to only one embodiment or one example, all components and features in either their broad or narrow formulations may be combined with other components or features to the extent such combinations would be recognized as logical by one of ordinary skill in the art.

The invention claimed is:

1. A valvetrain for an internal combustion engine of a type that has a combustion chamber, a moveable valve having a seat formed in the combustion chamber, and a camshaft, comprising:

a rocker arm assembly comprising a rocker arm and a cam follower configured to engage a cam mounted on a camshaft as the camshaft rotates; and a latch assembly comprising a latch pin that is mounted on the rocker arm and an actuator comprising an electromagnet that is mounted to a component of the engine other than the rocker arm;

wherein the latch pin is moveable between first and second positions;

the rocker arm is moveable independently from the electromagnet;

the actuator and the rocker arm assembly are positioned to make the electromagnet operable to cause the latch pin to translate between the first position and the second position; and the actuator and the rocker arm assembly are positioned to make the electromagnet operable to cause the latch pin to translate between the first position and the second position through magnetic flux that passes through the rocker arm.

2. A valvetrain according to claim 1, further comprising:

a pivot providing a fulcrum for the rocker arm;

wherein the electromagnet is mounted to the pivot.

3. An internal combustion engine comprising a valvetrain according to claim 1, wherein the component of the engine to which the electromagnet is mounted is in a fixed position relative to the combustion chamber.

4. A valvetrain according to claim 1, wherein:

the rocker arm has a load-bearing structure; and the magnetic flux passes through that load-bearing structure.

5. A valvetrain according to claim 1, wherein:

the rocker arm has a load-bearing structure that is paramagnetic; and the magnetic flux passes through a pole piece fixed to that load-bearing structure.

6. A valvetrain according to claim 1, wherein the rocker arm is formed primarily of low coercivity ferromagnetic material.

7. A valvetrain according to claim 1, further comprising:

a pivot providing a fulcrum for the rocker arm;

wherein the pivot, the actuator, and the rocker arm assembly are structured and positioned to make the electromagnet operable to cause the latch pin to translate between the first position and the second position through magnetic flux that passes through both the pivot and the rocker arm.

8. A valvetrain according to claim 1, wherein:

the magnetic flux considered in one of a North to South or South to North direction enters the latch pin directly from, or across only an air gap from, the rocker arm and leaves the latch pin crossing directly from or across only an air gap from the latch pin to a pole piece of the actuator; and the rocker arm is moveable independently from the pole piece of the actuator.

9. A valvetrain according to claim 1, wherein the latch pin completes a magnetic circuit that makes the electromagnet operative to cause the latch pin to translate between the first position and the second position such that if the latch were replaced by one made entirely from aluminum, the electromagnet would not be so operative.

10. A valvetrain according to claim 1, wherein:

one of the first and second latch pin positions provides a configuration in which the rocker arm assembly is operative to actuate the moveable valve in response to rotation of the camshaft to produce a first valve lift profile; and the other of the first and second latch pin positions provides a configuration in which the rocker arm assembly is operative to actuate the moveable valve in response to rotation of the camshaft to produce a second valve lift profile, which is distinct from the first valve lift profile, or the moveable valve is deactivated.

11. A valvetrain according to claim 1, wherein:

the rocker arm assembly is operative to form a force transmission pathway between the cam and the moveable valve; and the force transmission pathway includes the rocker arm.

12. An internal combustion engine comprising:

a valvetrain according to claim 1;

a cylinder head comprising a combustion chamber; and a valve cover;

wherein parts of the internal combustion engine including the cylinder head and the valve cover enclose a space between the cylinder head and the valve cover;

one of the parts that encloses the space is closer to the latch pin than any of the other parts enclosing the space;

there is a shortest path between the latch pin and the closest of the plurality of parts;

a pole piece of the actuator is positioned along the shortest path.

13. An internal combustion engine according to claim 12, wherein parts of the engine along the shortest path consist essentially of the pole piece of the actuator.

14. A valvetrain according to claim 1, wherein when the rocker arm is not being lifted by any cam, a line passing through the latch pin and oriented in a direction along which the latch pin translates between its first and second positions does not pass through the electromagnet.

15. A valvetrain according to claim 1, further comprising:

a second rocker arm assembly comprising a second rocker arm and a second latch assembly comprising a second latch pin mounted to the second rocker arm and moveable between first and second positions;

wherein the electromagnet is also operable to cause the second latch pin to translate between its first and second positions.

16. A valvetrain according to claim 1, wherein:

the latch assembly is structured to stabilize the latch pin in the first position against perturbations toward the second position independently from the electromagnet; and the latch assembly is structured to stabilize the latch pin in the second position against perturbations toward the first position independently from the electromagnet.

17. A valvetrain according to claim 16, wherein:

the latch assembly further comprises a permanent magnet in a position such that:

with the latch pin in the first position, and absent any magnetic fields generated by the electromagnet, the permanent magnet is operative to stabilize the latch pin in the first position through magnetic flux following a first magnetic circuit; and with the latch pin in the second position, and absent any magnetic fields generated by the electromagnet, the permanent magnet is operative to stabilize the latch pin in the second position through magnetic flux following a second magnetic circuit that is distinct from the first magnetic circuit.

18. A valvetrain according to claim 17, wherein one of the first magnetic circuit and the second magnetic circuit passes through the actuator and the other does not.

19. A valvetrain according to claim 17, wherein the permanent magnet is rigidly mounted in a fixed position on the rocker arm.

20. A valvetrain according to claim 17, wherein the permanent magnet is mounted to the actuator.

21. A valvetrain according to claim 1, wherein the latch pin passes through a hydraulic chamber formed by the rocker arm.

22. A method of manufacturing a valvetrain according to claim 1, comprising:

manufacturing a rocker arm with a hydraulic chamber for receiving a hydraulically actuated latch pin; and forming a valvetrain according to claim 1 using the manufactured rocker arm as the rocker arm of claim 1 and installing the latch pin of claim 1 through the hydraulic chamber.

23. A valvetrain for an internal combustion engine of a type that has a combustion chamber, a moveable valve having a seat formed in the combustion chamber, and a camshaft, comprising:

a rocker arm assembly comprising a rocker arm and a cam follower configured to engage a cam mounted on a camshaft as the camshaft rotates; and a latch assembly comprising a latch pin that is mounted on the rocker arm and an actuator comprising an electromagnet that is mounted to a component of the engine other than the rocker arm;

wherein the latch pin is moveable between first and second positions;

the rocker arm is moveable independently from the electromagnet;

the actuator and the rocker arm assembly are positioned to make the electromagnet operable to cause the latch pin to translate between the first position and the second position; and the rocker arm has a load-bearing structure that completes a magnetic circuit that makes the electromagnet operative to cause the latch pin to translate between the first position and the second position such that if the rocker arm were replaced by one made entirely from aluminum, the electromagnet would not be so operative.

24. A valvetrain for an internal combustion engine of a type that has a combustion chamber, a moveable valve having a seat formed in the combustion chamber, and a camshaft, comprising:

a rocker arm assembly comprising a rocker arm and a cam follower configured to engage a cam mounted on a camshaft as the camshaft rotates; and a latch assembly comprising a latch pin that is mounted on the rocker arm and an actuator comprising an electromagnet that is mounted to a component of the engine other than the rocker arm;

wherein the latch pin is moveable between first and second positions;

the rocker arm is moveable independently from the electromagnet;

the actuator and the rocker arm assembly are positioned to make the electromagnet operable to cause the latch pin to translate between the first position and the second position; and the electromagnet is mounted in a position such that while the cam is on base circle a line that passes through the latch pin and is oriented in a direction along which the latch pin translates between its first and second positions does not pass through the electromagnet.

25. A valvetrain according to claim 24, wherein the electromagnet is mounted in a position such that any line that is oriented in a direction along which the latch pin translates between its first and second positions and that passes through the latch pin while the cam is on base circle does not pass through the electromagnet.

26. A valvetrain according to claim 24, wherein:

the electromagnet is mounted in a position such that any line that is oriented in a direction along which the latch pin translates between its first and second positions and that passes through the latch pin does not pass through the electromagnet; and the positioning of the electromagnet is such that the foregoing condition regarding the electromagnets positioning remains satisfied even as the latch pin goes through a range of motion in conjunction with the rocker arm under the influence of the cam.

27. A valvetrain according to claim 24, wherein one of the rocker arm and a pivot that provides a fulcrum for the rocker arm assembly completes a magnetic circuit that makes the electromagnet operative to cause the latch pin to translate between the first position and the second position through magnetic flux.

28. An internal combustion engine comprising a valvetrain according to claim 24, wherein the electromagnet is held in a fixed position relative to the combustion chamber.

29. A valvetrain for an internal combustion engine of a type that has a combustion chamber, a moveable valve having a seat formed in the combustion chamber, and a camshaft, comprising:

a rocker arm assembly comprising a rocker arm and a cam follower configured to engage a cam mounted on a camshaft as the camshaft rotates; and a latch assembly comprising a latch pin that is mounted on the rocker arm and an actuator comprising an electromagnet that is mounted to a component of the engine other than the rocker arm;

wherein the latch pin is moveable between first and second positions;

the rocker arm is moveable independently from the electromagnet;

the actuator and the rocker arm assembly are positioned to make the electromagnet operable to cause the latch pin to translate between the first position and the second position;

the valvetrain further comprises a pivot that provides a fulcrum for the rocker arm; and the actuator and the fulcrum are positioned to make the electromagnet operable to cause the latch pin to translate between the first position and the second position through magnetic flux that passes through the pivot.

30. A valvetrain for an internal combustion engine of a type that has a combustion chamber, a moveable valve having a seat formed in the combustion chamber, and a camshaft, comprising:

a rocker arm assembly comprising a rocker arm and a cam follower configured to engage a cam mounted on a camshaft as the camshaft rotates; and a latch assembly comprising a latch pin that is mounted on the rocker arm and an actuator comprising an electromagnet that is mounted to a component of the engine other than the rocker arm;

wherein the latch pin is moveable between first and second positions;

the rocker arm is moveable independently from the electromagnet;

the actuator and the rocker arm assembly are positioned to make the electromagnet operable to cause the latch pin to translate between the first position and the second position;

the valvetrain further comprises a pivot that provides a fulcrum for the rocker arm; and the actuator and the fulcrum are positioned to make the electromagnet operable to cause the latch pin to translate between the first position and the second position through magnetic flux following a magnetic circuit that includes a part of the pivot that if replaced by a part made from aluminum would render the electromagnet no longer so operative.

31. A valvetrain for an internal combustion engine of a type that has a combustion chamber, a moveable valve having a seat formed in the combustion chamber, and a camshaft, comprising:

a rocker arm assembly comprising a rocker arm and a cam follower configured to engage a cam mounted on a camshaft as the camshaft rotates; and a latch assembly comprising a latch pin that is mounted on the rocker arm and an actuator comprising an electromagnet that is mounted to a component of the engine other than the rocker arm;

wherein the latch pin is moveable between first and second positions;

the rocker arm is moveable independently from the electromagnet;

the actuator and the rocker arm assembly are positioned to make the electromagnet operable to cause the latch pin to translate between the first position and the second position;

the electromagnet is operable to cause the latch pin to translate between the first position and the second position through magnetic flux that follows a magnetic circuit; and the magnetic circuit passes from the electromagnet to a pole piece that has a fixed location on the rocker arm, from the pole piece to the latch pin, from the latch pin across an air gap, and from across the air gap back to the electromagnet.

32. A valvetrain according to claim 31, further comprising:

a second pole piece, which is mounted to a component of the engine that is distinct from the rocker arm;

wherein the magnetic circuit passes from the electromagnet to the second pole, from the second pole piece to the first pole piece, and from the first pole piece to the latch pin.

* * * * *